US010476199B2

(12) United States Patent
Kim et al.

(10) Patent No.: US 10,476,199 B2
(45) Date of Patent: Nov. 12, 2019

(54) WATERPROOF CABLE CONNECTOR

(71) Applicant: Samsung Electronics Co., Ltd., Gyeonggi-do (KR)

(72) Inventors: Doo Ryong Kim, Gyeonggi-do (KR); Jae Won Yu, Gyeonggi-do (KR); Bong Jo Choi, Gyeonggi-do (KR); An Jin Nam, Gyeonggi-do (KR); Jeong Mi Baek, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/875,099

(22) Filed: Jan. 19, 2018

(65) Prior Publication Data

US 2018/0212355 A1 Jul. 26, 2018

(30) Foreign Application Priority Data

Jan. 20, 2017 (KR) ..... 10-2017-0009634

(51) Int. Cl.
*H01R 13/52* (2006.01)
*H01R 31/06* (2006.01)
(Continued)

(52) U.S. Cl.
CPC ..... *H01R 13/5202* (2013.01); *H01R 13/5205* (2013.01); *H01R 13/5213* (2013.01);
(Continued)

(58) Field of Classification Search
CPC ..... H01R 13/5205; H01R 13/5221; H01R 13/5202
(Continued)

(56) References Cited

U.S. PATENT DOCUMENTS 4,318,580 A * 3/1982 Fleisher ..... H01R 4/2429 439/403
4,531,796 A * 7/1985 Gansert ..... H01R 13/5221 439/271
(Continued)

FOREIGN PATENT DOCUMENTS

EP 2 975 713 A1 1/2016
JP H9-243832 A 9/1997
(Continued)

OTHER PUBLICATIONS

International Search Report dated May 4, 2018.

*Primary Examiner* — Tulsidas C Patel
*Assistant Examiner* — Marcus E Harcum
(74) *Attorney, Agent, or Firm* — Cha & Reiter, LLC

(57) ABSTRACT

A waterproof cable connector may include a body having a substantially cylindrical shape and including a first upper surface, a first lower surface, and a first lateral surface, the body having a first hollow, a sealing member including a second upper surface, a second lower surface, and a second lateral surface and having a hole, the sealing member being inserted into the body, and a cap including a third upper surface, a third lower surface, and a third lateral surface and having a second hollow interior. The body may have a tapered surface formed on a portion of the inside of the first lateral surface. The sealing member may have a tapered surface formed on a portion of the outside of the second lateral surface. And at least one recess is formed in at least one of the second upper surface and the second lower surface.

20 Claims, 48 Drawing Sheets

(51) Int. Cl.

| | |
|---|---|
| ***H01R 24/20*** | (2011.01) |
| ***H01R 24/64*** | (2011.01) |
| *H01R 13/623* | (2006.01) |
| *H01R 13/622* | (2006.01) |
| *H01R 13/59* | (2006.01) |

(52) U.S. Cl.
CPC ..... *H01R 24/20* (2013.01); *H01R 24/64* (2013.01); *H01R 31/06* (2013.01); *H01R 13/5219* (2013.01); *H01R 13/59* (2013.01); *H01R 13/622* (2013.01); *H01R 13/623* (2013.01)

(58) Field of Classification Search
USPC ..... 439/275, 677, 680, 378, 587, 589
See application file for complete search history.

(56) References Cited

U.S. PATENT DOCUMENTS 4,737,119 A * 4/1988 Stieler ..... H01R 13/625 439/318
6,817,902 B2 * 11/2004 Bernardi ..... G02B 6/3879 439/274
7,326,090 B2 * 2/2008 Cayzac ..... H01R 13/6453 439/378
7,762,842 B2 * 7/2010 Deubel ..... H01R 13/5208 439/589
8,007,302 B2 * 8/2011 Kleinke ..... H01R 9/03 439/275
9,287,659 B2 * 3/2016 Burris ..... H01R 9/0524
2006/0166554 A1 * 7/2006 Hung ..... H01R 13/5205 439/589
2007/0218757 A1 * 9/2007 Guala ..... A61M 39/045 439/589
2010/0323557 A1 * 12/2010 Seiler ..... H01R 13/5202 439/589
2013/0099452 A1 * 4/2013 Hein ..... H01R 13/5205 277/607
2013/0203287 A1 * 8/2013 Natoli ..... H01R 9/0524 439/578
2014/0256166 A1 * 9/2014 Ramos ..... H01R 13/5221 439/271
2015/0255912 A1 * 9/2015 Natter ..... H01R 13/18 439/589
2017/0201084 A1 * 7/2017 Steinberg ..... H01R 4/70
2017/0288335 A1 * 10/2017 Hsu ..... G02B 6/36
2018/0241151 A1 * 8/2018 Lane ..... H01R 13/5219

FOREIGN PATENT DOCUMENTS

JP 2002-262439 A 9/2002
JP 3163371 U 10/2010
KR 10-1091043 B1 12/2011
KR 10-2016-0024666 A 3/2016
WO WO-2012029996 A1 * 3/2012 ..... H01R 4/646

* cited by examiner

WATERPROOF CABLE CONNECTOR

CLAIM OF PRIORITY

This application claims the benefit under 35 U.S.C. § 119(a) of a Korean patent application filed on Jan. 20, 2017 in the Korean Intellectual Property Office and assigned Serial number 10-2017-0009634, the entire disclosure of which is hereby incorporated by reference.

TECHNICAL FIELD

Embodiments disclosed herein generally relate to a cable connector, and more particularly relate to a waterproof cable connector.

BACKGROUND

When a cable is connected to an electronic device, a connection between the cable and the electronic device may be limited in its waterproofing performance. Accordingly, when the cable is connected to the electronic device, a waterproof cable connector may be used for waterproofing of the connection between the cable and the electronic device. For example, a body, a sealing member, and a cap of the waterproof cable connector may be sequentially mounted on and fastened to the cable. At this time, the sealing member may be compressed by the body and the cap to air-tightly seal a hole into which the cable is inserted, thereby implementing a waterproofing function.

SUMMARY

However, the waterproof cable connector in the related art may have a limitation in that the body may have to be formed of an elastically deformable material, such as a plastic resin, to compress the sealing member. Furthermore, when the sealing member is compressed by the body and the cap, the sealing member may not be uniformly compressed, which may lead to degradation in a waterproofing function.

Aspects of the present disclosure address at least the above-mentioned problems and/or disadvantages and provide at least the advantages described below. Accordingly, an aspect of the present disclosure is to provide a waterproof cable connector that includes a body having a sloping inner surface to allow a sealing member to be effectively inserted into the body and the sealing member having a sloping outer surface so as to be effectively inserted into the body and having a recess formed in an upper surface or a lower surface thereof so as to be easily compressed by external pressure.

In accordance with an aspect of the present disclosure, a waterproof cable connector may include a body having a substantially cylindrical shape and including a first upper surface, a first lower surface, and a first lateral surface surrounding a space between the first upper surface and the first lower surface, the body having a first hollow interior extending through the first upper surface and the first lower surface, a sealing member including a second upper surface, a second lower surface, and a second lateral surface surrounding a space between the second upper surface and the second lower surface and having a hole formed through a portion of the second upper surface and a portion of the second lower surface, the sealing member being inserted into the body in a direction from the first upper surface to the first lower surface, and a cap including a third upper surface, a third lower surface, and a third lateral surface surrounding a space between the third upper surface and the third lower surface and having a second hollow interior extending through a portion of the third upper surface and a portion of the third lower surface, the third lower surface being recessed toward the third upper surface and the cap being coupled with the body to cover the first upper surface and a portion of the first lateral surface. The body may have a tapered surface formed on a portion of the inside of the first lateral surface that is adjacent to the first upper surface. The sealing member may have a tapered surface formed on a portion of the outside of the second lateral surface that is adjacent to the second lower surface. And at least one recess is formed in at least one of the second upper surface and the second lower surface.

According to embodiments disclosed herein, since the body may have a sloping inner surface to allow the sealing member to be effectively inserted into the body, a portion of the body does not have to be elastically deformed, and thus the body may be formed of a high-stiffness material.

Furthermore, according to embodiments disclosed herein, since the sealing member may have a recess formed in the upper surface or the lower surface thereof, the sealing member may be uniformly compressed by external pressure applied thereto.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
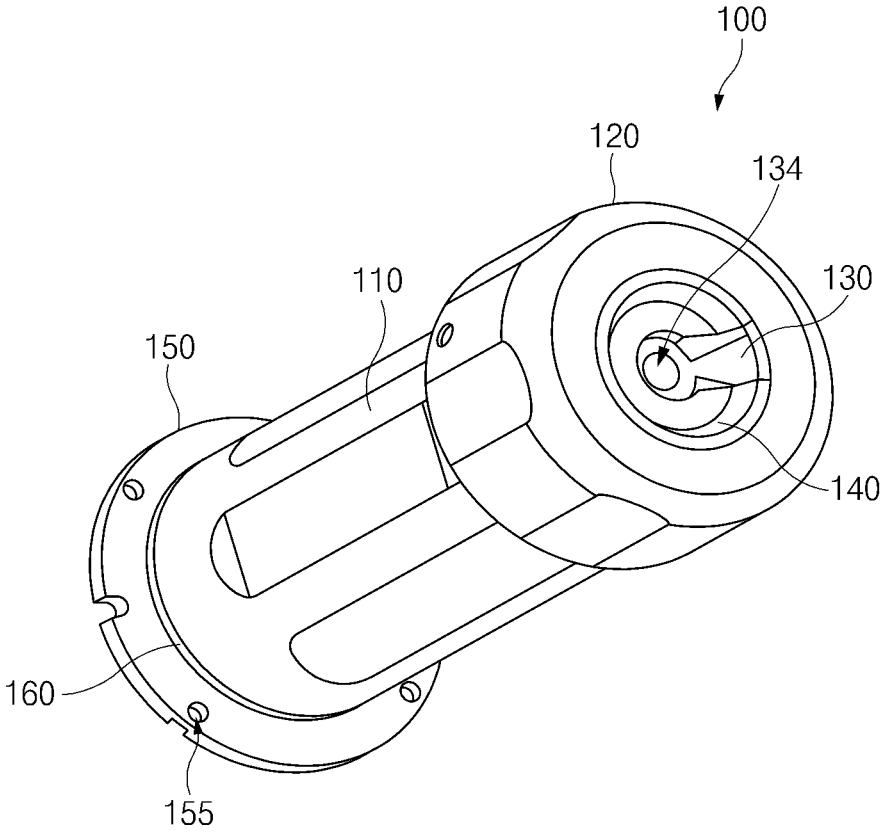
FIG. 1 is a perspective view of a waterproof cable connector according to an embodiment of the present disclosure.

Hereinafter, various embodiments of the present disclosure are disclosed with reference to the accompanying drawings. However, the present disclosure is not intended to be limited by the various embodiments of the present disclosure to a specific embodiment and it is intended that the present disclosure covers all modifications, equivalents, and/or alternatives of the present disclosure provided they come within the scope of the appended claims and their equivalents. With respect to the descriptions of the accompanying drawings, like reference numerals refer to like elements.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The term "include," "comprise," and "have", or "may include," or "may comprise" and "may have" used herein indicates disclosed functions, operations, or existence of elements but does not exclude other functions, operations or elements.

For example, the expressions "A or B," or "at least one of A and/or B" may indicate A and B, A, or B. For instance, the expression "A or B" or "at least one of A and/or B" may indicate (1) at least one A, (2) at least one B, or (3) both at least one A and at least one B.

The terms such as "1st," "2nd," "first," "second," and the like used herein may refer to modifying various different elements of various embodiments of the present disclosure, but are not intended to limit the elements. For instance, "a first user device" and "a second user device" may indicate different users regardless of order or importance. For example, a first component may be referred to as a second component and vice versa without departing from the scope and spirit of the present disclosure.

In various embodiments of the present disclosure, it is intended that when a component (for example, a first component) is referred to as being "operatively or communicatively coupled with/to" or "connected to" another component (for example, a second component), the component may be directly connected to the other component or connected through another component (for example, a third component). In various embodiments of the present disclosure, it is intended that when a component (for example, a first component) is referred to as being "directly connected to" or "directly accessed" another component (for example, a second component), another component (for example, a third component) does not exist between the component (for example, the first component) and the other component (for example, the second component).

The expression "configured to" used in various embodiments of the present disclosure may be interchangeably used with "suitable for," "having the capacity to," "designed to," "adapted to," "made to," or "capable of" according to the situation, for example. The term "configured to" may not necessarily indicate "specifically designed to" in terms of hardware. Instead, the expression "a device configured to" in some situations may indicate that the device and another device or part are "capable of" For example, the expression "a processor configured to perform A, B, and C" may indicate a dedicated processor (for example, an embedded processor) for performing a corresponding operation or a general purpose processor (for example, a central processing unit (CPU) or application processor (AP)) for performing corresponding operations by executing at least one software program stored in a memory device.

Terms used in various embodiments of the present disclosure are used to describe certain embodiments of the present disclosure, but are not intended to limit the scope of other embodiments. The terms of a singular form may include plural forms unless they have a clearly different meaning in the context. Otherwise, all terms used herein may have the same meanings that are generally understood by a person skilled in the art. In general, terms defined in a dictionary should be considered to have the same meanings as the contextual meaning of the related art, and, unless clearly defined herein, should not be understood differently or as having an excessively formal meaning. In any case, even the terms defined in the present specification are not intended to be interpreted as excluding embodiments of the present disclosure.

An electronic device according to various embodiments of the present disclosure may include at least one of a smartphone, a tablet personal computer (PC), a mobile phone, a video telephone, an electronic book reader, a desktop PC, a laptop PC, a netbook computer, a workstation, a server, a personal digital assistant (PDA), a portable multimedia player (PMP), a Motion Picture Experts Group (MPEG-1 or MPEG-2) Audio Layer 3 (MP3) player, a mobile medical device, a camera, or a wearable device. The wearable device may include at least one of an accessory-type device (e.g., a watch, a ring, a bracelet, an anklet, a necklace, glasses, a contact lens, a head-mounted device (HMD)), a textile- or clothing-integrated-type device (e.g., an electronic apparel), a body-attached-type device (e.g., a skin pad or a tattoo), or a bio-implantable-type device (e.g., an implantable circuit)

In some various embodiments of the present disclosure, an electronic device may be a home appliance. The smart home appliance may include at least one of, for example, a television (TV), a digital video/versatile disc (DVD) player, an audio, a refrigerator, an air conditioner, a cleaner, an oven, a microwave oven, a washing machine, an air cleaner, a set-top box, a home automation control panel, a security control panel, a television (TV) box (e.g., Samsung HomeSync™, Apple TV™, or Google TV™), a game console (e.g., Xbox™ or PlayStation™), an electronic dictionary, an electronic key, a camcorder, or an electronic picture frame In other various embodiments of the present disclosure, an electronic device may include at least one of various medical devices (e.g., various portable medical measurement devices (e.g., a blood glucose measuring device, a heart rate measuring device, a blood pressure measuring device, a body temperature measuring device, or the like), a magnetic resonance angiography (MRA), a magnetic resonance imaging (MRI), a computed tomography (CT), a scanner, an ultrasonic device, or the like), a navigation device, a global navigation satellite system (GNSS), an event data recorder (EDR), a flight data recorder (FDR), a vehicle infotainment device, electronic equipment for vessels (e.g., a navigation system, a gyrocompass, or the like), avionics, a security device, a head unit for a vehicle, an industrial or home robot, an automatic teller machine (ATM), a point of sales (POS) device of a store, or an Internet of things (IoT) device (e.g., a light bulb, various sensors, an electric or gas meter, a sprinkler, a fire alarm, a thermostat, a streetlamp, a toaster, exercise equipment, a hot water tank, a heater, a boiler, or the like).

According to various embodiments of the present disclosure, an electronic device may include at least one of a part of furniture or a building/structure, an electronic board, an electronic signature receiving device, a projector, or a measuring instrument (e.g., a water meter, an electricity meter, a gas meter, a wave meter, or the like). An electronic device may be one or more combinations of the above-mentioned devices. An electronic device according to some various embodiments of the present disclosure may be a flexible device. An electronic device according to an embodiment of the present disclosure is not limited to the above-mentioned devices, and may include new electronic devices with the development of new technology.

Hereinafter, an electronic device according to various embodiments of the present disclosure will be described in more detail with reference to the accompanying drawings. The term "user" used herein may refer to a person who uses an electronic device or may refer to a device (e.g., an artificial intelligence electronic device) that uses an electronic device.

Figure 2:
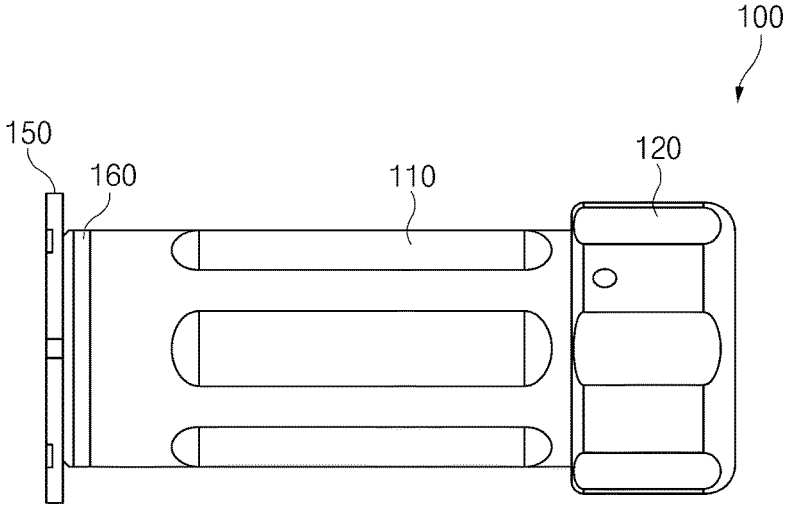
FIG. 2 is a side view of the waterproof cable connector according to an embodiment of the present disclosure.
Figure 3:
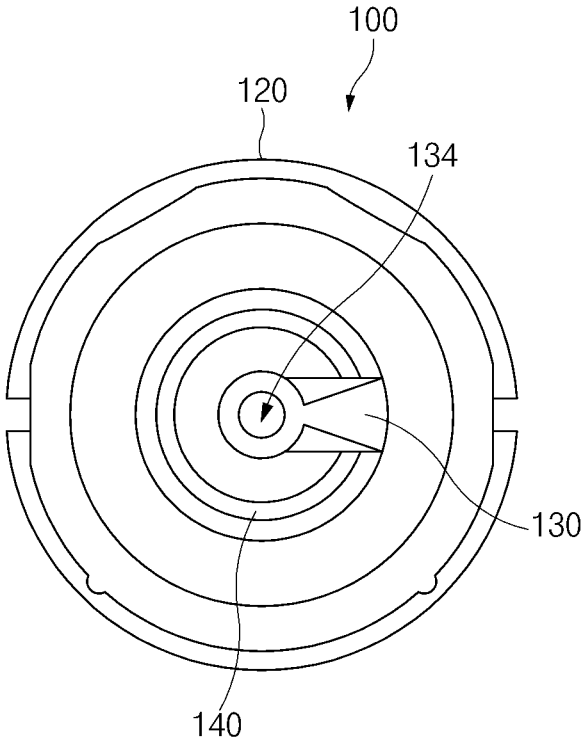
FIG. 3 is a front view of the waterproof cable connector according to an embodiment of the present disclosure.
Figure 4:
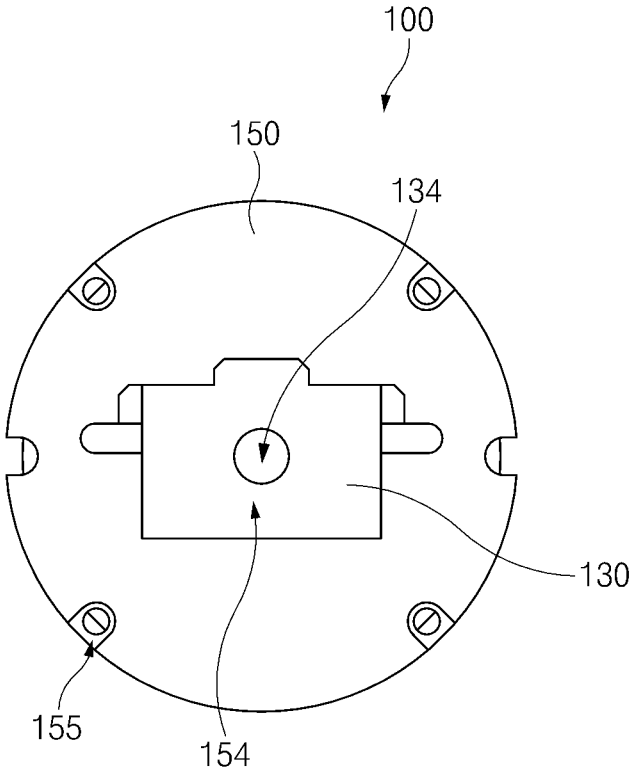
FIG. 4 is a rear view of the waterproof cable connector according to an embodiment of the present disclosure.

FIG. 1 is a perspective view of a waterproof cable connector according to an embodiment. FIG. 2 is a side view of the waterproof cable connector according to an embodiment. FIG. 3 is a front view of the waterproof cable connector according to an embodiment. FIG. 4 is a rear view of the waterproof cable connector according to an embodiment.

Referring to FIGS. 1 to 4, a waterproof cable connector 100 may include a body 110, a cap 120, a sealing member 130 (which may be formed from a rubber or rubber like or elastomeric material, for example, to facilitate a sealing connection) a washer 140, and/or a connecting unit 150. However, a configuration of the waterproof cable connector 100 is not limited thereto. According to various embodiments, the waterproof cable connector 100 may not include at least one of the aforementioned elements and may further include at least one other element.

The body 110 may have a substantially cylindrical shape. The body 110 may have an upper surface (or a front surface) and a lower surface (or a rear surface) that have a substantially circular shape, and a lateral surface of the body 110 may surround a space between the upper surface and the lower surface of the body 110. The body 110 may have a hollow cylindrical shape. For example, the body 110 may have a hollow interior extending through the upper surface and the lower surface thereof.

The body 110 may have an inner diameter larger than the outer diameter of a cable (e.g., a general-purpose connecting cable) to allow the cable to be inserted into the body 110. For example, the hollow interior formed inside the body 110 may have a diameter larger than the outer diameter of the cable and/or may approximate the dimeter of the cable when the cable is inserted into the body 110.

The body 110 may have a sloping portion on an inner surface thereof. For example, a portion of the inner surface of the body 110, into which the sealing member 130 is inserted, may be tapered. The sealing member 130 may be effectively inserted into the body 110 through the tapered surface in the longitudinal direction of the waterproof cable connector 100.

The body 110 may be formed of a material having a stiffness of at least a predetermined or specified value. For example, the body 110 may be formed of metal, such as stainless steel (STS), aluminum (Al), steel, or the like. In another example, the body 110 may be formed of a plastic material.

The cap 120 may be releasably coupled with the body 110 to cover the upper surface of the body 110 and a portion of the lateral surface of the body 110. For example, the cap 120 may have an upper surface (or a front surface) and a lower surface (or a rear surface) that has a substantially circular shape, and a lateral surface of the cap 120 may surround a space between the upper surface and the lower surface of the cap 120. Furthermore, the lower surface of the cap 120 may be recessed toward the upper surface of the cap 120 to allow the cap 120 to be coupled with the body 110. That is, the cap 120 may include a recessed portion configured to accommodate a portion of the body 110 therein. Furthermore, the cap 120 may have an inner diameter larger than the outer diameter of the body 110. Accordingly, the body 110 may be coupled with the cap 120 in such a manner that the body 110 is inserted into the space formed inside the cap 120. Furthermore, the cap 120 may include a hollow interior extending through the upper surface and the lower surface thereof, into which the cable is inserted.

According to an embodiment, the cap 120 may have, on an inner surface thereof, a structure that is to be coupled with the body 110. For example, the cap 120 may have a first screw structure (e.g., a screw thread or a screw valley) or a protrusion formed on the inner surface thereof to correspond to a second screw structure (e.g., a screw valley or a screw thread) or a bayonet structure formed on an outer surface of the body 110. However, a structure in which the body 110 and the cap 120 are coupled together is not limited thereto. In an embodiment, the body 110 and the cap 120 may be coupled together through a screw member or may be hook-coupled to each other.

The sealing member 130 may have a substantially cylindrical shape. For example, the sealing member 130 may have an upper surface (or a front surface) and a lower surface (or a rear surface) that have a substantially circular shape, and a lateral surface of the sealing member 130 may surround a space between the upper surface and the lower surface of the sealing member 130. The sealing member 130 may have a sloping portion on an outer surface thereof such that the sealing member 130 is effectively inserted into the body 110. For example, a portion of the outer surface of the sealing member 130, which is inserted into the body 110, may be tapered.

The sealing member 130 may have a specified elasticity or higher. Accordingly, the sealing member 130 may be compressed when inserted into the body 110 and may be brought into close contact with the inner surface of the body 110 by a restoring force corresponding to the elasticity after inserted into the body 110.

The sealing member 130 may include a hole 134 formed through the upper surface and the lower surface thereof, in which the cable is mounted. The hole 134 may have the same diameter as, or a diameter similar to, that of the cable. According to an embodiment, the sealing member 130 may have a cutting line (e.g., a cut) formed from the central portion thereof, in which the hole is formed, to the lateral surface to allow the cable to be inserted into the sealing member 130 in the lateral direction. Accordingly, the cable may be inserted into the sealing member 130 through the cutting line.

When the sealing member 130 is inserted into the body 110, the sealing member 130 may be pushed into the body 110 along the tapered surface formed on the inner surface of the body 110, and pressure may be applied to the sealing member 130 toward the cable (e.g., toward the center of the sealing member 130). Accordingly, the sealing member 130 may be compressed inside the body 110 by the pressure, and thus waterproofing of the cable may be implemented.

According to an embodiment, the sealing member 130 may have at least one recess (or cut-out region) formed in the upper surface or the lower surface thereof so that the sealing member 130 may be uniformly compressed by external pressure applied thereto when the sealing member 130 is inserted into the body 110. For example, the recess may be formed to a specified depth in the direction from the upper surface or the lower surface to the center of the sealing member 130. According to an embodiment, the recess may have a fan shape in which a surface adjacent to the outer surface of the sealing member 130 is longer in length than a surface adjacent to the center point of the sealing member 130. In another example, the total volume of the recess formed in the sealing member 130 may correspond to half of the volume of the sealing member 130.

The washer 140 may be disposed between the sealing member 130 and the cap 120 to prevent the sealing member 130 inserted into the body 110 from escaping to the outside through the hollow interior formed in the cap 120. Furthermore, the washer 140 may press the upper surface of the sealing member 130 to a predetermined pressure. When the sealing member 130 inserted into the body 110 is compressed, a reaction force to cause the sealing member 130 to escape from the body 110 may be generated. The washer 140 may function as a blocking membrane disposed between the sealing member 130 and the cap 120 to prevent the sealing member 130 from escaping from the body 110. The force by which the washer 140 supports the sealing member 130 may be provided by a structure in which an opening formed in the washer 140 is smaller in size than the hollow interior formed in the cap 120 and the cap 120 is assembled to the body 110. Due to the pressure of the washer 140, the sealing member 130 may not deform upwards. For example, a portion of the sealing member 130 may not escape to the outside through the hollow interior formed in the cap 120, and pressure loss may be prevented. The washer 140 may have the same outer diameter as, or an outer diameter similar to, that of the sealing member 130. According to an embodiment, the washer 140 may have, in a central portion thereof, a through-hole in which the cable is located. In another example, the washer 140 may have an opening formed from the central portion, in which the through-hole is formed, to a lateral surface thereof to allow the cable to be inserted into the washer 140 in the lateral direction. According to an embodiment, the washer 140 may be formed of a hard material, such as metal, a plastic resin, or the like.

The connecting unit 150 may have one side coupled with the body 110 and an opposite side coupled with an electronic device to which the cable is connected. For example, the connecting unit 150 may be configured to dock the waterproof cable connector 100 to the electronic device. The connecting unit 150 may have a structure that is to be coupled with the body 110. For example, the connecting unit 150 may have a first screw structure (e.g., a screw thread or a screw valley) or a bayonet structure formed on an outer surface thereof to correspond to a second screw structure (e.g., a screw valley or a screw thread) or a protrusion formed on the inner surface of the body 110. However, a structure in which the body 110 and the connecting unit 150 are coupled together is not limited thereto. In an embodiment, the body 110 and the connecting unit 150 may be coupled together through a screw member or may be hook-coupled to each other. Furthermore, the connecting unit 150 may have a screw hole 155 for securing the connecting unit 150 to the electronic device. For example, at least one screw hole 155 may be formed in an edge area (or peripheral portion) of the connecting unit 150.

The connecting unit 150 may have, in a central portion thereof, a hollow interior 154 having a shape corresponding to that of a cable connector (e.g., a jack) of the electronic device to which the cable is connected. The hollow interior 154 may have a diverse shape depending on the shape of the cable connector of the electronic device.

According to an embodiment, the waterproof cable connector 100 may further include a waterproof member 160 for waterproofing between the waterproof cable connector 100 and the electronic device to which the cable is connected. For example, the waterproof member 160 may be mounted to surround a portion of the outer surface of the body 110 to allow the body 110 coupled with the connecting unit 150 to be brought into close contact with the electronic device in the state in which the connecting unit 150 is fastened to the electronic device. According to an embodiment, the waterproof member 160 may have a strap shape and may be formed of an elastic material (e.g., rubber or the like) having a specified elasticity. For example, the waterproof member 160 may include an O-ring.

Figure 5:
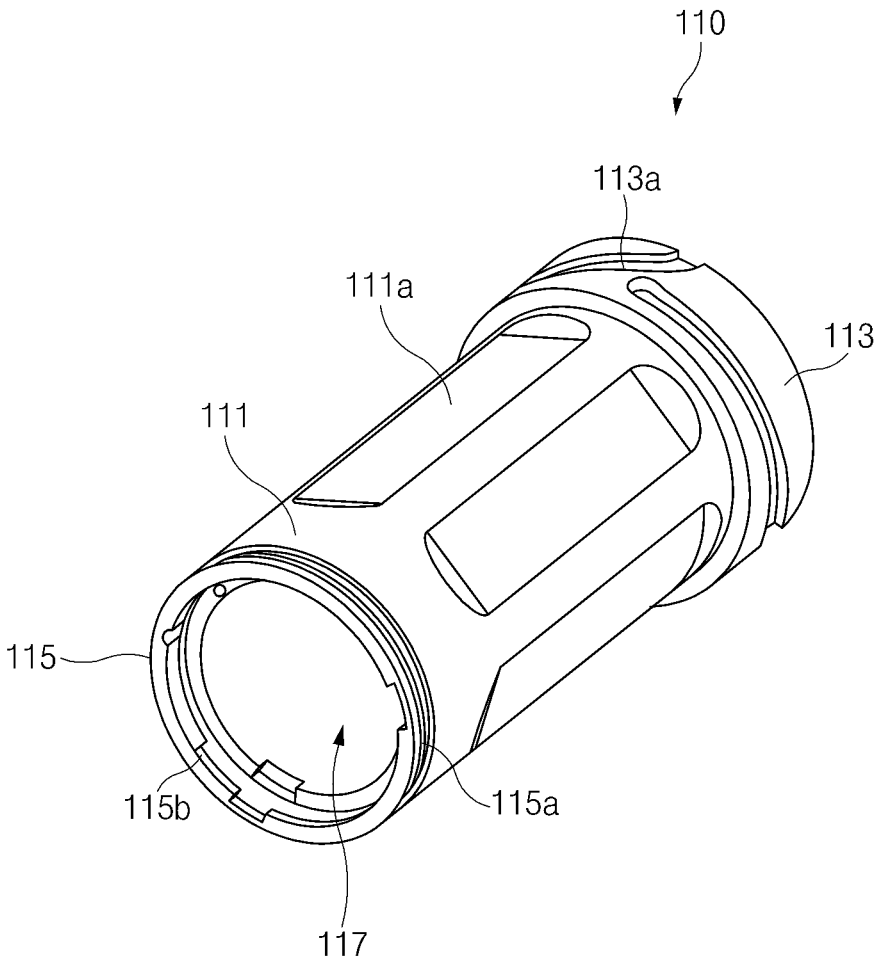
FIG. 5 is a perspective view of a body of a waterproof cable connector according to an embodiment of the present disclosure.
Figure 6:
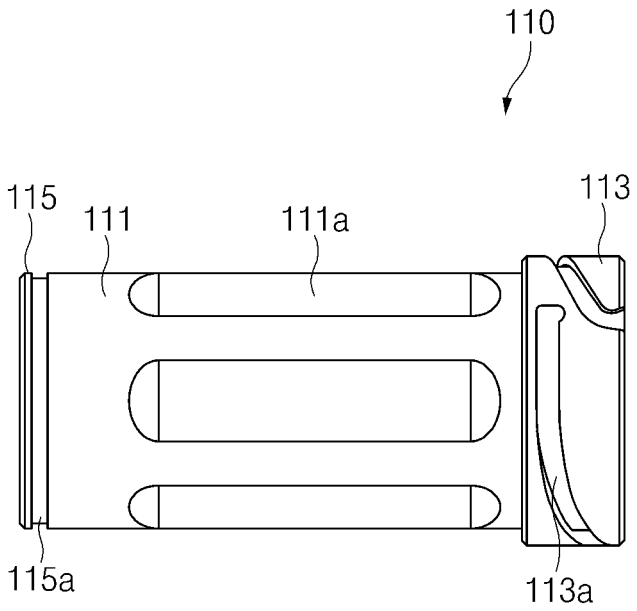
FIG. 6 is a side view of the body of the waterproof cable connector according to an embodiment of the present disclosure.
Figure 7:
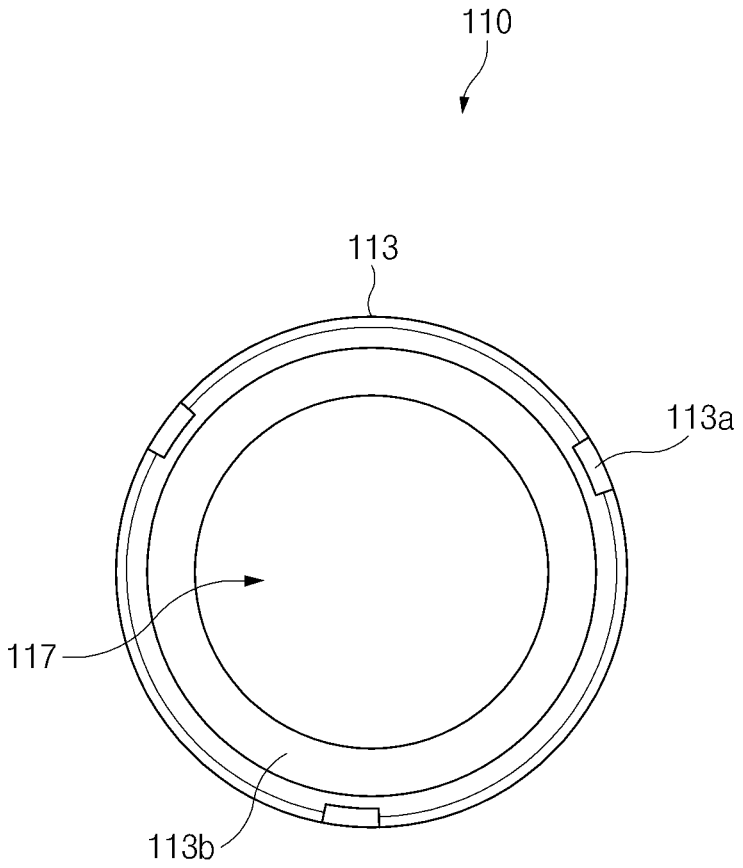
FIG. 7 is a front view of the body of the waterproof cable connector according to an embodiment of the present disclosure.
Figure 8:
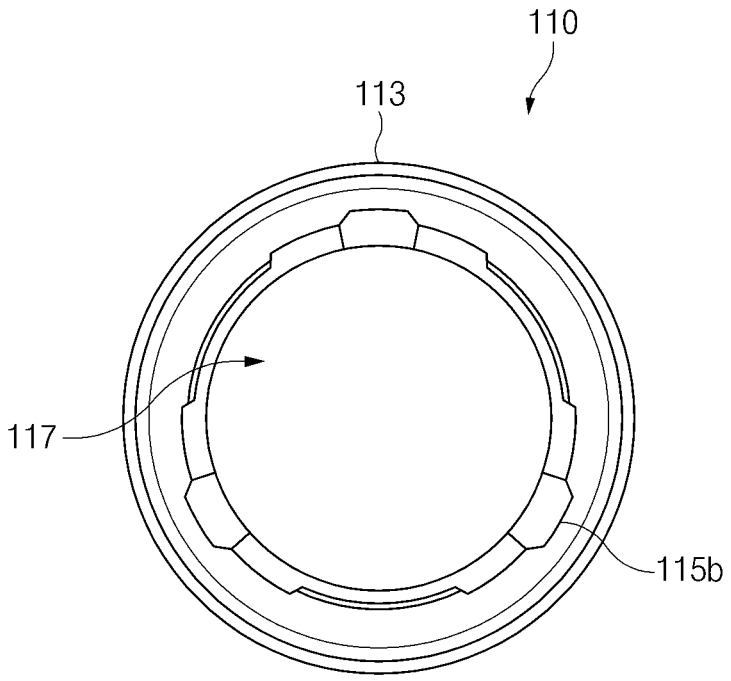
FIG. 8 is a rear view of the body of the waterproof cable connector according to an embodiment of the present disclosure.
Figure 9:
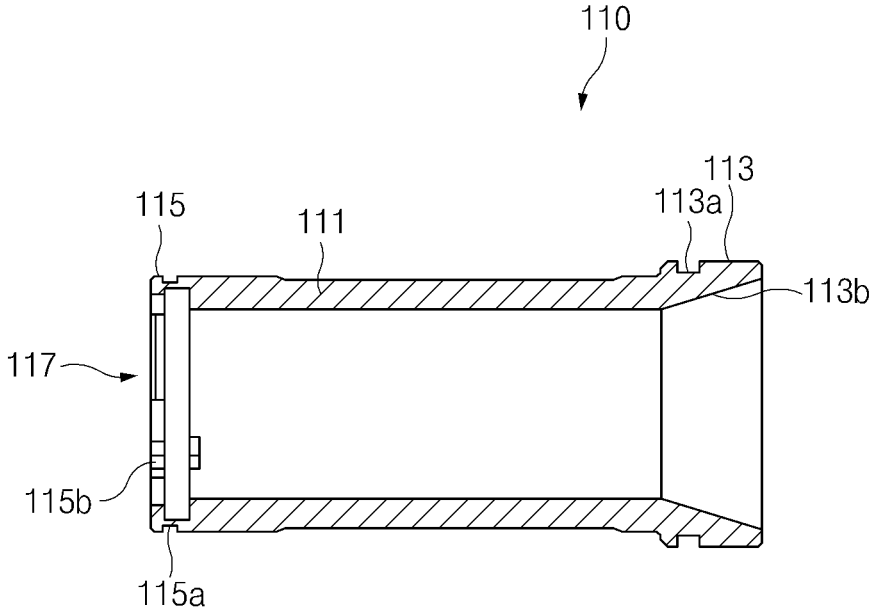
FIG. 9 is a sectional view of the body of the waterproof cable connector according to an embodiment of the present disclosure.

FIG. 5 is a perspective view of a body of a waterproof cable connector according to an embodiment. FIG. 6 is a side view of the body of the waterproof cable connector according to an embodiment. FIG. 7 is a front view of the body of the waterproof cable connector according to an embodiment. FIG. 8 is a rear view of the body of the waterproof cable connector according to an embodiment. FIG. 9 is a sectional view of the body of the waterproof cable connector according to an embodiment.

Referring to FIGS. 5 to 9, the body 110 of the waterproof cable connector 100 may include a middle part 111, an upper part 113 connected to an upper end of the middle part 111, and a lower part 115 connected to a lower end of the middle part 111. The middle part 111 of the body 110 may have a substantially long cylindrical shape. For example, an upper surface and a lower surface of the middle part 111 may have a substantially circular shape, and a lateral surface of the middle part 111 may surround a space between the upper surface and the lower surface of the middle part 111. Furthermore, the middle part 111 of the body 110 may have a hollow cylindrical shape. For example, the middle part 111 of the body 110 may have a hollow interior 117 extending through the upper surface and the lower surface thereof.

According to an embodiment, the middle part 111 of the body 110 may have at least one run-out groove 111*a* formed thereon, for example, along the length of the body 110. For example, when a user grips the middle part 111 of the body 110 by using a part of the user's body, the run-out groove 111*a* may prevent slipping of the body part. In an embodiment, slipping may be prevented by knurling an outer surface of the middle part 111. In another example, the middle part 111 of the body 110 may have a polygonal prism shape (e.g., a hexagonal prism shape) as an alternative to forming the run-out groove 111*a* on the middle part 111 of the body 110.

The upper part 113 of the body 110 may have a substantially cylindrical shape. The upper part 113 may have a smaller height and a larger outer diameter than the middle part 111. Furthermore, likewise to the middle part 111, the upper part 113 of the body 110 may have a hollow cylindrical shape. For example, the hollow interior 117 may extend through at least a portion of the upper part 113 and/or through an upper surface and/or lower surface thereof.

According to an embodiment, the upper part 113 of the body 110 may have a structure that is to be coupled with the cap 120. For example, the upper part 113 may have a bayonet structure 113*a* formed on an outer surface thereof. However, a structure in which the upper part 113 of the body 110 may be coupled with the cap 120 is not limited thereto. In an embodiment, the upper part 113 may have, on the outer surface thereof, the second screw structure corresponding to the first screw structure formed on the inner surface of the cap 120. Alternatively, the upper part 113 may have, on the outer surface thereof, a hook that is stopped by a stopper formed on the inner surface of the cap 120. In another example, a screw fixing plate may be formed between the middle part 111 and the upper part 113 of the body 110 or on the outer surface of the upper part 113. In this case, the screw fixing plate may be brought into close contact with a screw fixing plate formed on the outer surface of the cap 120, and the screw fixing plates may be coupled together through a screw member.

According to an embodiment, the upper part 113 of the body 110 may have a tapered inner surface 113*b*. For example, the upper part 113 of the body 110 may have the smallest inner diameter at a place adjacent to the middle part 111 and may have a gradually increasing inner diameter away from the middle part 111.

The lower part 115 of the body 110 may have a substantially cylindrical shape. The lower part 115 may have a smaller height than the middle part 111 and the upper part 113. Furthermore, likewise to the middle part 111 and the upper part 113, the lower part 115 of the body 110 may have a hollow cylindrical shape. For example, the hollow interior 117 of the lower part 115 of the body 110 may extend through an upper surface and a lower surface thereof.

According to an embodiment, an area 115*a* of the lower part 115 of the body 110 may be connected with the middle part 111 may have a smaller diameter than the remaining area of the lower part 115. Accordingly, in the case where the waterproof member 160, such as an O-ring, is mounted on the body 110, the waterproof member 160 may be seated on the area 115*a*.

According to an embodiment, the lower part 115 of the body 110 may have, on an inner surface thereof, a structure that is to be coupled with the connecting unit 150. For example, the lower part 115 may have a bayonet structure 115*b* formed on the inner surface thereof. However, a structure in which the lower part 115 of the body 110 is coupled with the connecting unit 150 is not limited thereto. In an embodiment, the lower part 115 may have, on the inner surface thereof, a third screw structure (e.g., a screw thread or a screw valley) corresponding to a fourth screw structure (e.g., a screw valley or a screw thread) formed on the outer surface of the connecting unit 150. Alternatively, the lower part 115 may have, on the inner surface thereof, a hook that is stopped by a stopper formed on the outer surface of the connecting unit 150. In another example, the lower part 115 may have a screw fixing plate formed on an outer surface thereof. In this case, the screw fixing plate may be brought into close contact with a screw fixing plate formed on one surface of the connecting unit 150, and the screw fixing plates may be coupled together through a screw member.

Figure 10:
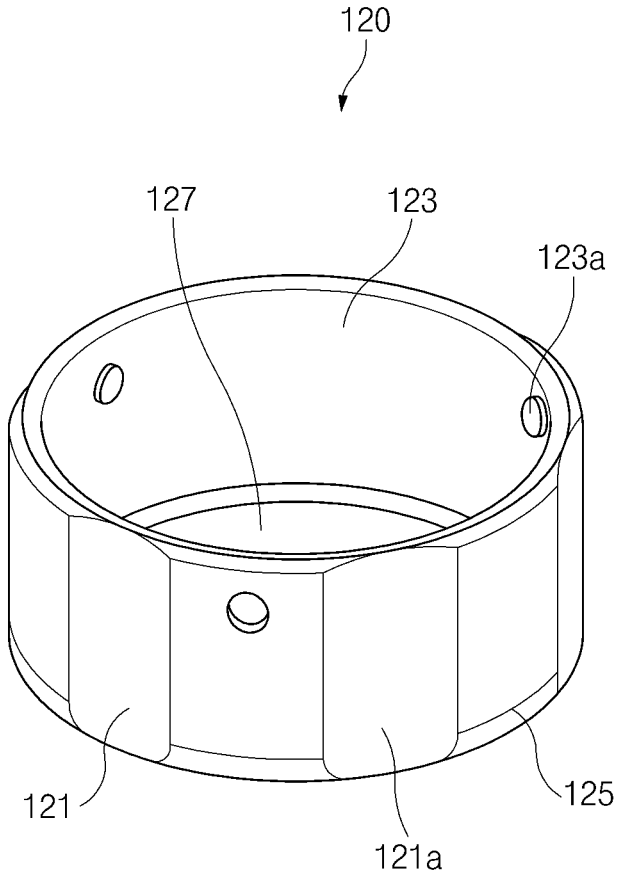
FIG. 10 is a perspective view of a cap of a waterproof cable connector according to an embodiment of the present disclosure.
Figure 11:
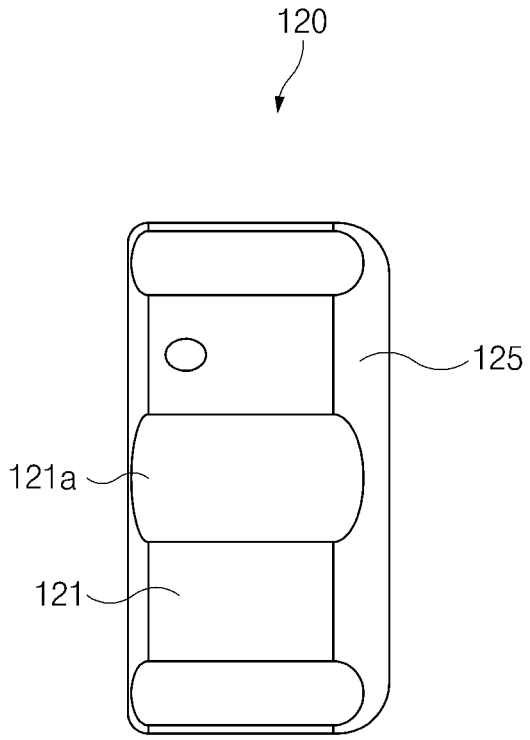
FIG. 11 is a side view of the cap of the waterproof cable connector according to an embodiment of the present disclosure.
Figure 12:
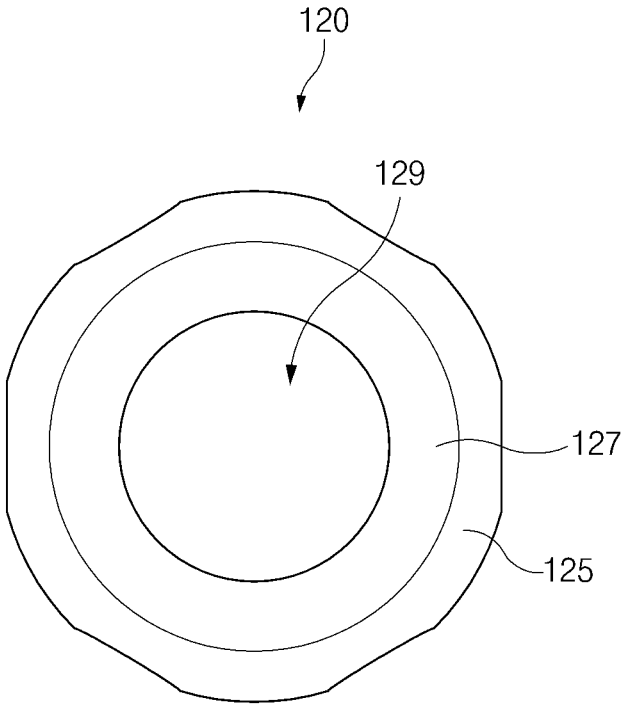
FIG. 12 is a front view of the cap of the waterproof cable connector according to an embodiment of the present disclosure.
Figure 13:
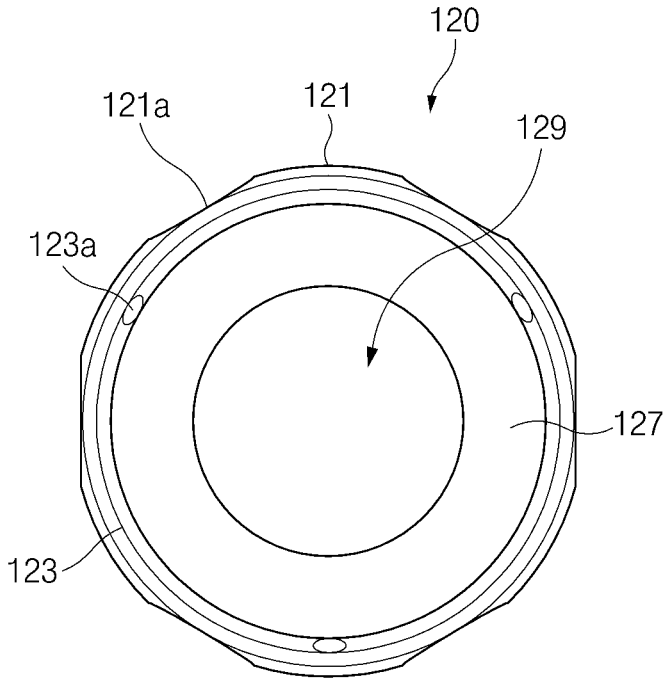
FIG. 13 is a rear view of the cap of the waterproof cable connector according to an embodiment of the present disclosure.

FIG. 10 is a perspective view of a cap of a waterproof cable connector according to an embodiment. FIG. 11 is a side view of the cap of the waterproof cable connector according to an embodiment. FIG. 12 is a front view of the cap of the waterproof cable connector according to an embodiment. FIG. 13 is a rear view of the cap of the waterproof cable connector according to an embodiment.

Referring to FIGS. 10 to 13, the cap 120 of the waterproof cable connector 100 may have an upper surface 125 and a lower surface 127 that have a substantially circular shape, and a lateral surface (e.g., an outer surface 121 and an inner surface 123) of the cap 120 may surround a space between the upper surface 125 and the lower surface 127 of the cap 120. Furthermore, the cap 120 of the waterproof cable connector 100 may have a hollow interior 129 extending through the upper surface 125 and the lower surface 127 thereof, and a cable may be inserted into the hollow interior 129 of the cap 120.

According to an embodiment, the lower surface 127 of the cap 120 of the waterproof cable connector 100 may be recessed toward the upper surface 125 of the cap 120 to allow the cap 120 to be coupled with the body 110. Furthermore, the cap 120 may have an inner diameter larger than the outer diameter of the body 110. Accordingly, the body 110 of the waterproof cable connector 100 may be coupled with the cap 120 in such a manner that the body 110 is inserted into the space formed inside the cap 120. According to an embodiment, the cap 120 may have at least one run-out groove 121*a* formed on the outer surface 121 thereof. For example, when a user grips the cap 120 by using a part of the user's body, the run-out groove 121*a* may prevent slipping of the body part. In an embodiment, slipping may be prevented by knurling the outer surface 121 of the cap 120. In another example, the cap 120 may have a polygonal prism shape (e.g., a hexagonal prism shape) as an alternative to forming the run-out groove 121*a* on the outer surface 121 of the cap 120.

According to an embodiment, the cap 120 may have, on the inner surface 123 thereof, a structure that is to be coupled with the body 110. For example, a protrusion 123*a* may be formed on the inner surface 123 of the cap 120 to correspond to the bayonet structure 113*a* formed on the outer surface of the body 110. However, a structure in which the body 110 and the cap 120 are coupled together is not limited thereto. In an embodiment, the first screw structure may be formed on the inner surface 123 of the cap 120 to correspond to the second screw structure formed on the outer surface of the body 110. Alternatively, the cap 120 may have, on the inner surface 123 thereof, a stopper by which the hook formed on the outer surface of the body 110 is stopped. In another example, the cap 120 may have a screw fixing plate formed on the outer surface 121 thereof. In this case, the screw fixing plate may be brought into close contact with a screw fixing plate formed on the outer surface of the body 110, and the screw fixing plates may be coupled together through a screw member.

Figure 14A:
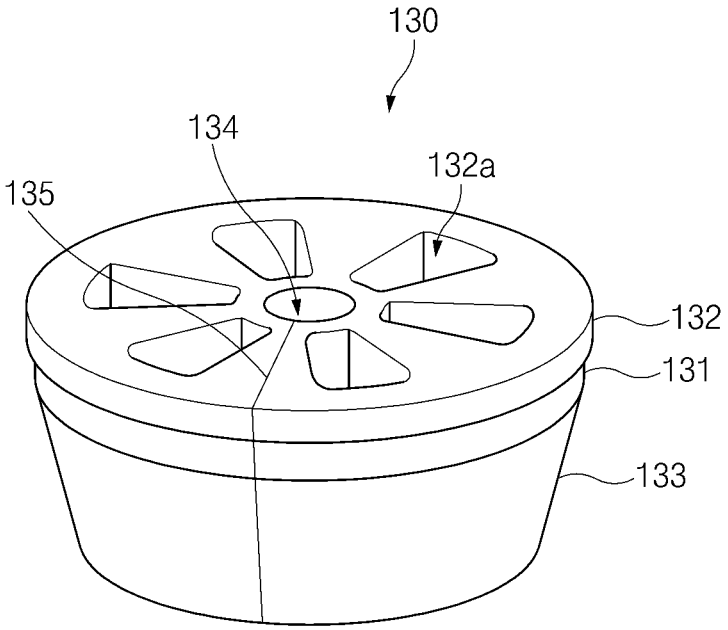
FIG. 14A is a perspective view of a sealing member of a waterproof cable connector according to an embodiment of the present disclosure.
Figure 14B:
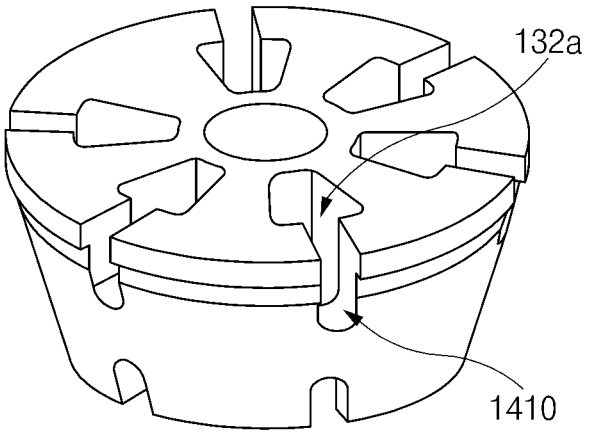
FIG. 14B is a perspective view of another structure of a sealing member according to an embodiment of the present disclosure.
Figure 15:
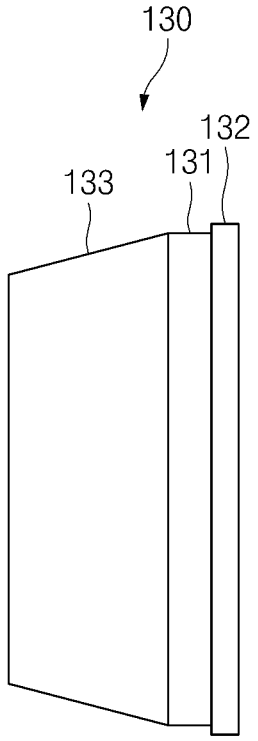
FIG. 15 is a side view of the sealing member of the waterproof cable connector according to an embodiment of the present disclosure.
Figure 16:
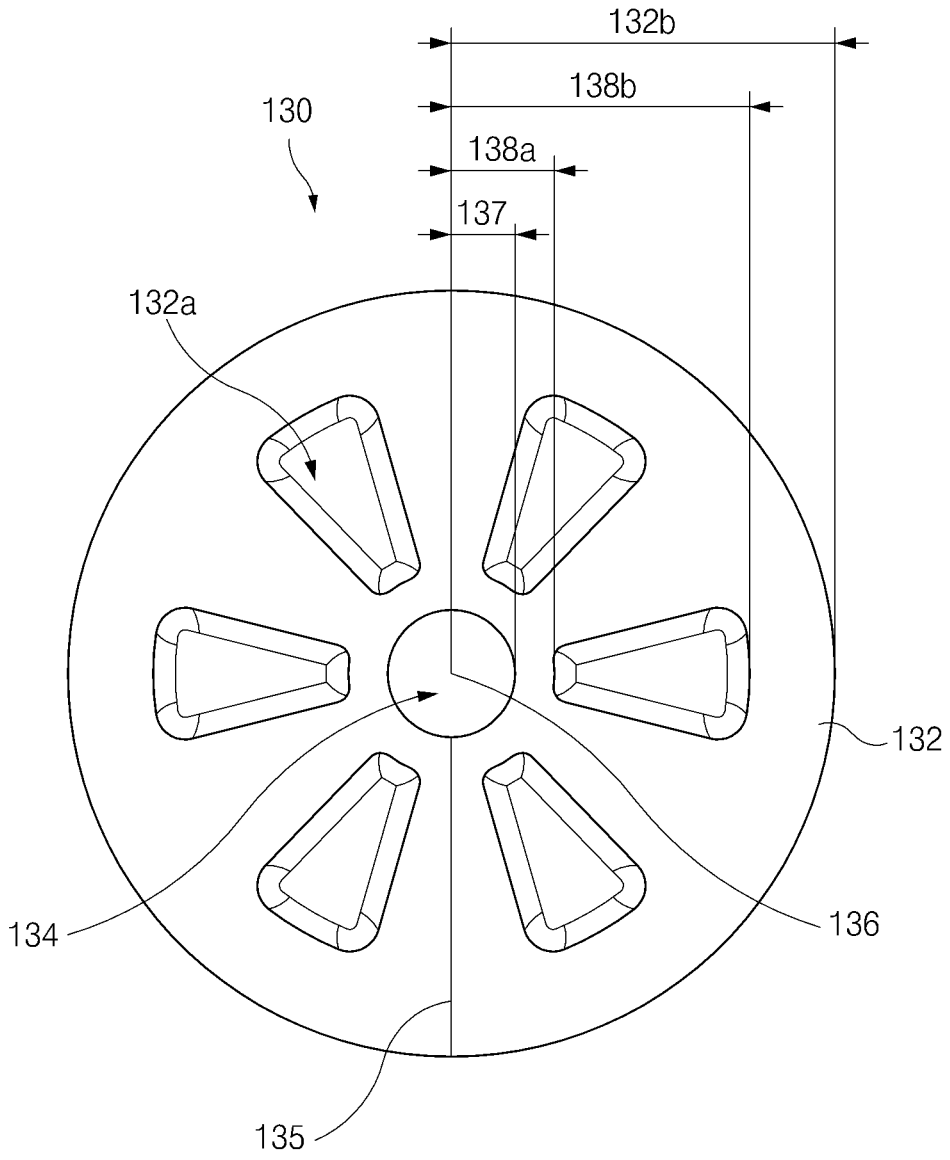
FIG. 16 is a front view of the sealing member of the waterproof cable connector according to an embodiment of the present disclosure.
Figure 17:
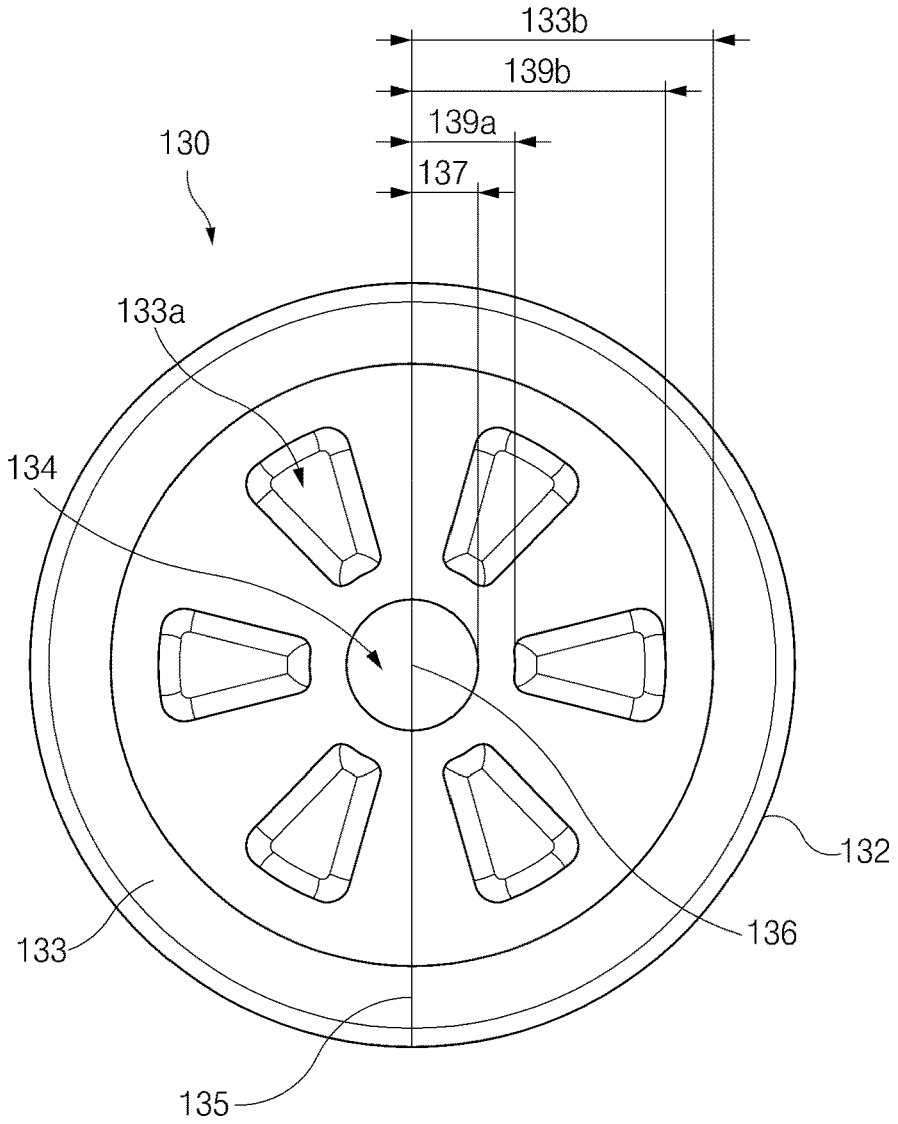
FIG. 17 is a rear view of the sealing member of the waterproof cable connector according to an embodiment of the present disclosure.

FIG. 14A is a perspective view of a sealing member of a waterproof cable connector according to an embodiment, and FIG. 14B is a perspective view of another structure of a sealing member according to an embodiment. FIG. 15 is a side view of the sealing member of the waterproof cable connector according to an embodiment. FIG. 16 is a front view of the sealing member of the waterproof cable connector according to an embodiment. FIG. 17 is a rear view of the sealing member of the waterproof cable connector according to an embodiment.

Referring to FIGS. 14A to 17, the sealing member 130 of the waterproof cable connector 100 may include a middle part 131, an upper part 132 connected to an upper end of the middle part 131, and a lower part 133 connected to a lower end of the middle part 131. The sealing member 130 of the waterproof cable connector 100 may have the hole 134 formed in the center thereof, in which a cable is located. Furthermore, the middle part 131, the upper part 132, and the lower part 133 of the sealing member 130 may have a substantially circular shape.

The upper part 132 of the sealing member 130 may have a larger diameter than the middle part 131 and the lower part 133. Furthermore, the upper part 132 may have a larger diameter than the hollow interior 117 formed inside the body 110. Accordingly, when the sealing member 130 is inserted (e.g., press-fit) into the body 110, the middle part 131 and the lower part 133 of the sealing member 130 may be compressed and then expand by a restoring force to make close contact with the inner surface of the body 110, and a protruding structure on the upper part 132 of the sealing member 130 may be mounted on an upper end of the hollow interior 117 of the body 110. Furthermore, since the upper part 132 of the sealing member 130, together with the middle part 131, forms a step (e.g., the upper part 132 forms a protruding structure), the upper part 132 may be used when a user detaches the sealing member 130 using a part of the user's body (e.g., a fingernail) or another object that can be used to separate the parts from one another as it is wedged therebetween.

According to an embodiment, the upper part 132 of the sealing member 130 may have at least one recess 132*a* formed therein. For example, the recess 132*a* may be formed to a specified depth in a direction from an upper surface of the upper part 132 to the center of the sealing member 130. In an embodiment, the recess 132*a* may be formed from the upper surface of the upper part 132 to a portion of the middle part 131 or a portion of the lower part 133. According to an embodiment, the recess 132*a* may have a fan shape in which a surface adjacent to the outer surface of the sealing member 130 is longer in length than a surface adjacent to a center point 136 of the sealing member 130.

According to an embodiment, the recess 132*a* formed in the upper part 132 of the sealing member 130 may be spaced a specified distance apart from the hole 134 formed in the center of the sealing member 130 and the outer surface of the sealing member 130. For example, a distance 138*a* between the center point 136 of the sealing member 130 and the surface of the recess 132*a* that is adjacent to the center point 136 of the sealing member 130 may be longer than a radius 137 of the hole 134, and a distance 138*b* between the center point 136 of the sealing member 130 and the surface of the recess 132*a* that is adjacent to the outer surface of the sealing member 130 may be shorter than a radius 132*b* of the upper surface of the sealing member 130.

According to an embodiment, the lower part 133 of the sealing member 130 may have a tapered outer surface. For example, the lower part 133 of the sealing member 130 may have the largest diameter at a place adjacent to the middle part 131 and may have a gradually decreasing diameter away from the middle part 131.

According to an embodiment, the lower part 133 of the sealing member 130 may have at least one recess 133*a* formed therein. For example, the recess 133*a* may be formed to a specified depth in a direction from a lower surface of the lower part 133 to the center of the sealing member 130. In an embodiment, the recess 133*a* may be formed from the lower surface of the lower part 133 to a portion of the middle part 131 or a portion of the upper part 132. According to an embodiment, the recess 133*a* may have a fan shape in which a surface adjacent to the outer surface of the sealing member 130 is longer in length than a surface adjacent to the center point 136 of the sealing member 130.

According to an embodiment, the recess 133*a* formed in the lower part 133 of the sealing member 130 may be spaced a specified distance apart from the hole 134 formed in the center of the sealing member 130 and the outer surface of the sealing member 130. For example, a distance 139*a* between the center point 136 of the sealing member 130 and the surface of the recess 133*a* that is adjacent to the center point 136 of the sealing member 130 may be longer than the radius 137 of the hole 134, and a distance 139*b* between the center point 136 of the sealing member 130 and the surface of the recess 133*a* that is adjacent to the outer surface of the sealing member 130 may be shorter than a radius 133*b* of the lower surface of the sealing member 130.

According to an embodiment, the total volume of the recesses formed in the sealing member 130 may correspond to half of the volume of the sealing member 130. For example, the total volume of the recess 132*a* formed in the upper part 132 and the recess 133*a* formed in the lower part 133 of the sealing member 130 may correspond to half of the volume of the sealing member 130.

According to an embodiment, the sealing member 130 may have a cutting line 135 formed from the hole 134, which is formed in the center of the sealing member 130, to the outer surface of the sealing member 130 to allow a cable to be inserted into the sealing member 130 in the lateral direction. Accordingly, the cable may be inserted into the sealing member 130 through the cutting line 135.

According to an embodiment, as illustrated in FIG. 14B, the sealing member 130 may have one or more recesses (or cut-out regions) 1410 formed in a lateral surface thereof. The recesses 1410 may be formed to a specified depth from the lateral surface of the sealing member 130. In an embodiment, the recesses 1410 may be connected with the first recess 132*a* formed in the upper surface of the sealing member 130 and/or the second recess 133*a* formed in the lower surface of the sealing member 130. For example, at least one of the recesses 1410 may be integrally formed with the first recess 132*a* or the second recess 133*a*.

According to an embodiment, the sealing member 130 may have at least one recess (or cut-out region) formed in the upper surface or the lower surface thereof so that the sealing member 130 may be uniformly compressed when inserted into the body 110. For example, the sealing member 130 may include the first recess 132*a* formed to a specified depth in the direction from the upper surface to the lower surface thereof and the second recess 133*a* formed to a specified depth in the direction from the lower surface to the upper surface thereof.

The at least one recess (e.g., the first recess 132*a* and the second recess 133*a*) formed in the sealing member 130 may provide a space by which a lateral part of the sealing member 130 easily moves in a direction 2830 toward the center of the sealing member 130 when the sealing member 130 is compressed. Accordingly, the sealing member 130 may not be crushed when compressed.

According to an embodiment, the sealing member 130 may have at least one recess (or cut-out region) formed in the upper surface or the lower surface thereof so that the sealing member 130 may be uniformly compressed by external pressure applied thereto when the sealing member 130 is inserted into the body 110. For example, the recess may be formed to a specified depth in the direction from the upper surface or the lower surface to the center of the sealing member 130. According to an embodiment, the recess may have a fan shape in which a surface adjacent to the outer surface of the sealing member 130 is longer in length than a surface adjacent to the center point of the sealing member 130. In another example, the total volume of the recess formed in the sealing member 130 may correspond to half of the volume of the sealing member 130.

Figure 18:
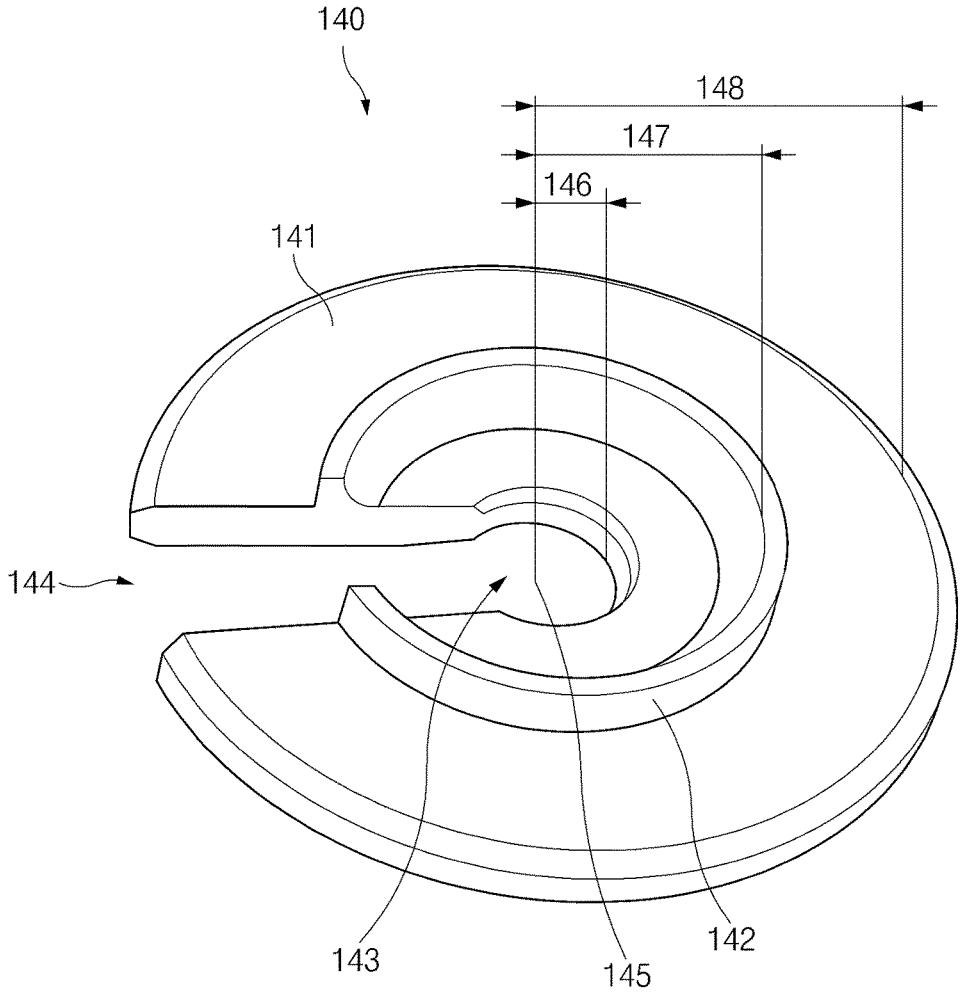
FIG. 18 is a perspective view of a washer of a waterproof cable connector according to an embodiment of the present disclosure.
Figure 19:
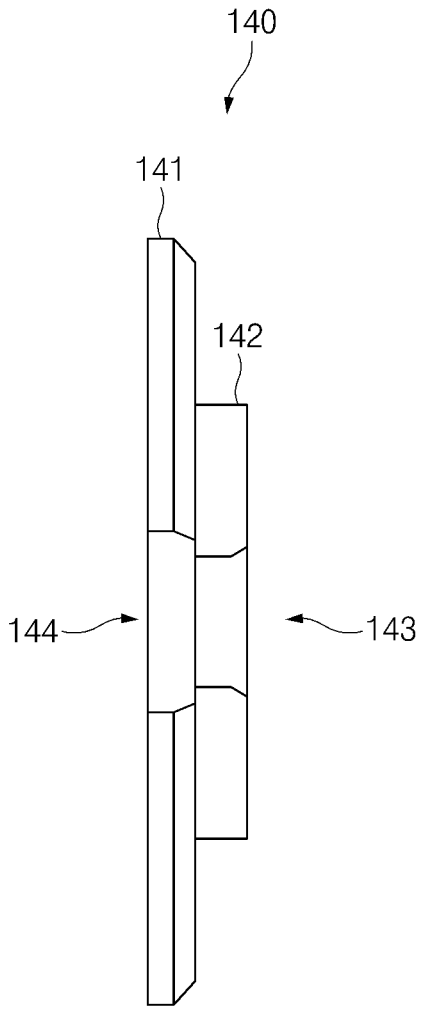
FIG. 19 is a side view of the washer of the waterproof cable connector according to an embodiment of the present disclosure.
Figure 20:
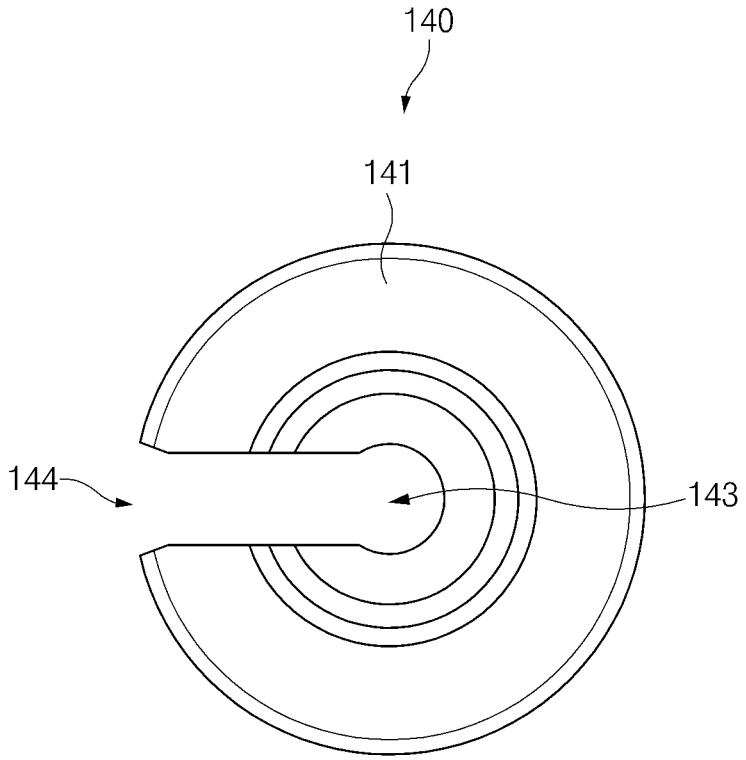
FIG. 20 is a rear view of the washer of the waterproof cable connector according to an embodiment of the present disclosure.

FIG. 18 is a perspective view of a washer of a waterproof cable connector according to an embodiment. FIG. 19 is a side view of the washer of the waterproof cable connector according to an embodiment. FIG. 20 is a rear view of the washer of the waterproof cable connector according to an embodiment.

Referring to FIGS. 18 to 20, the washer 140 of the waterproof cable connector 100 may be disposed between the sealing member 130 and the cap 120 to prevent the sealing member 130 inserted into the body 110 from escaping to the outside through the hollow interior 129 formed in the cap 120. According to an embodiment, the washer 140 may have the shape of a substantially circular plate 141. The diameter of the plate 141 may be the same as, or similar to, the outer diameter of the sealing member 130. Furthermore, the diameter of the plate 141 may be larger than the diameter of the hollow interior 117 formed in the body 110 and the diameter of the hollow interior 129 formed in the cap 120 and may be smaller than the diameter of the cap 120.

According to an embodiment, the washer 140 of the waterproof cable connector 100 may have, in a central portion thereof, a through-hole 143 in which the cable is located. In another example, the washer 140 may have an opening 144 formed in the central portion of the washer 140, and the through-hole 143 may be formed at an end of the opening 144 and may be centrally disposed in the washer 140 such that the cable may be inserted into the washer 140 in the lateral direction.

According to an embodiment, the washer 140 of the waterproof cable connector 100 may have a protrusion 142 formed on one surface thereof. For example, the washer 140 may have the protrusion 142 formed on one surface of the plate 141. For example, the protrusion 142 may have a shape similar to that of the hollow interior 129 formed in the cap 120 and may have a smaller diameter than the hollow interior 129 formed in the cap 120. Accordingly, the protrusion 142 may be exposed to the outside through the hollow interior 129 formed in the cap 120 and may be stopped by the upper surface 125 of the cap 120 to prevent the washer 140 from moving inside the cap 120.

According to an embodiment, the protrusion 142 may be spaced a specified distance apart from the through-hole 143 formed in the central portion of the washer 140 and the outer surface of the washer 140. For example, a distance 147 from a center point 145 of the washer 140 to the protrusion 142 may be longer than a radius 146 of the through-hole 143 and may be shorter than a radius 148 of the washer 140.

Figure 21:
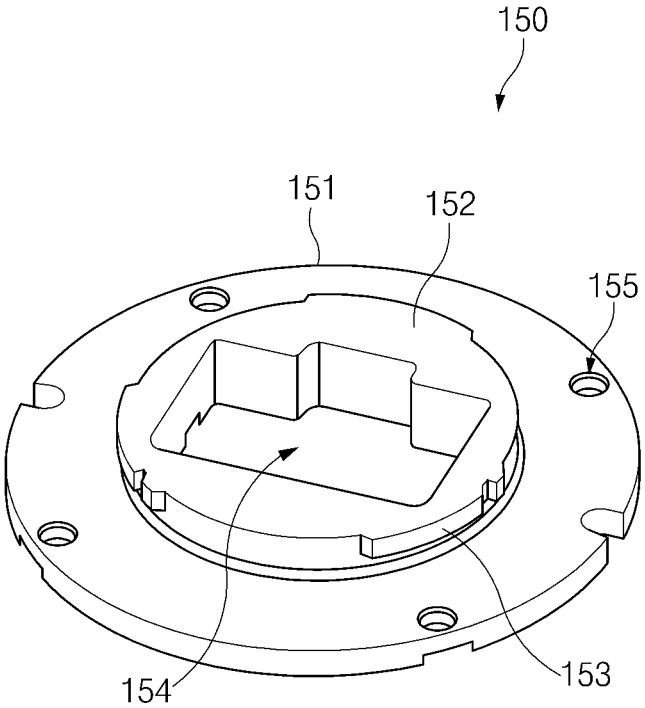
FIG. 21 is a perspective view of a connecting unit of a waterproof cable connector according to an embodiment of the present disclosure.
Figure 22:
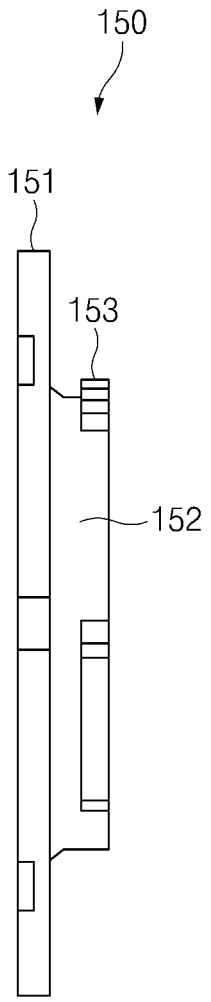
FIG. 22 is a side view of the connecting unit of the waterproof cable connector according to an embodiment of the present disclosure.
Figure 23:
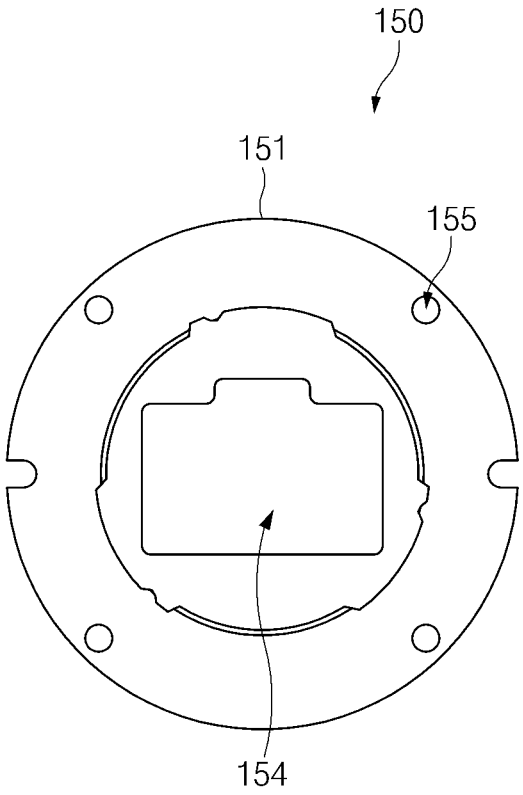
FIG. 23 is a rear view of the connecting unit of the waterproof cable connector according to an embodiment of the present disclosure.

FIG. 21 is a perspective view of a connecting unit of a waterproof cable connector according to an embodiment. FIG. 22 is a side view of the connecting unit of the waterproof cable connector according to an embodiment. FIG. 23 is a rear view of the connecting unit of the waterproof cable connector according to an embodiment.

Referring to FIGS. 21 to 23, the connecting unit 150 of the waterproof cable connector 100 may have one side coupled with the body 110 and an opposite side may be coupled with an electronic device to which a cable may be connected. The connecting unit 150 of the waterproof cable connector 100 may include a central part 152 and a peripheral part 151 surrounding the central part 152. According to an embodiment, the central part 152 and the peripheral part 151 of the connecting unit 150 may have a substantially circular shape.

According to an embodiment, the central part 152 of the connecting unit 150 may have a protruding shape. For example, the central part 152 of the connecting unit 150 may protrude from an upper surface of the peripheral part 151 toward the upper surface of the waterproof cable connector 100.

According to an embodiment, the central part 152 of the connecting unit 150 may have the hollow interior 154 formed in an area thereof. For example, the hollow interior 154 may be formed through a portion of an upper surface and a portion of a lower surface of the central part 152. The hollow interior 154 may have a shape corresponding to that of a cable connector of the electronic device.

According to an embodiment, the central part 152 of the connecting unit 150 may have, on an outer surface thereof, a structure that is to be coupled with the body 110. For example, the central part 152 may have, on the outer surface thereof, a protrusion 153 corresponding to the bayonet structure 115*b* formed on the inner surface of the lower part 115 of the body 110. However, a structure in which the connecting unit 150 is coupled to the body 110 is not limited thereto. In an embodiment, the central part 152 may have, on the outer surface thereof, the fourth screw structure corresponding to the third screw structure formed on the inner surface of the body 110. Alternatively, the central part 152 may have, on the outer surface thereof, a hook that is stopped by the stopper formed on the inner surface of the body 110. In another example, the peripheral part 151 of the connecting unit 150 may have a screw fixing plate formed thereon. In this case, the screw fixing plate may be brought into close contact with the screw fixing plate formed on the outer surface of the body 110, and the screw fixing plates may be coupled together through a screw member.

According to an embodiment, the peripheral part 151 of the connecting unit 150 may have at least one screw hole 155 formed therein. A screw member may be inserted into the screw hole 155, and thus the connecting unit 150 may be secured to the electronic device.

Figure 24:
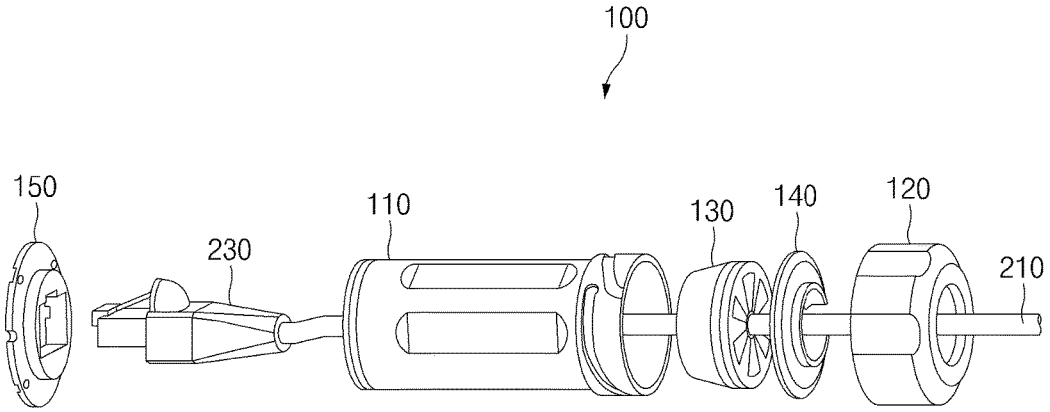
FIG. 24 is an exploded perspective view of a waterproof cable connector according to an embodiment of the present disclosure.

FIG. 24 is an exploded perspective view of a waterproof cable connector according to an embodiment.

Referring to FIG. 24, the waterproof cable connector 100 may include the body 110, the cap 120, the sealing member 130, the washer 140, and the connecting unit 150. However, a configuration of the waterproof cable connector 100 is not limited thereto. According to an embodiment, the waterproof cable connector 100 may not include at least one of the aforementioned elements and may further include at least one other element. For example, the waterproof cable connector 100 may further include the waterproof member 160 mounted on the outer surface of the body 110 to allow the body 110 to make close contact with an electronic device to which a cable 210 is connected. In an embodiment, the waterproof cable connector 100 may not include at least one of the washer 140 and the connecting unit 150. According to various embodiments, in the case where the waterproof cable connector 100 does not include the connecting unit 150, one side of the body 110 of the waterproof cable connector 100 may be fastened to a connecting unit included in the electronic device. In this case, the connecting unit included in the electronic device may be configured such that a connecting part 230 (e.g., a plug) on a distal end of the cable 210 is inserted into the connecting unit.

Figure 25:
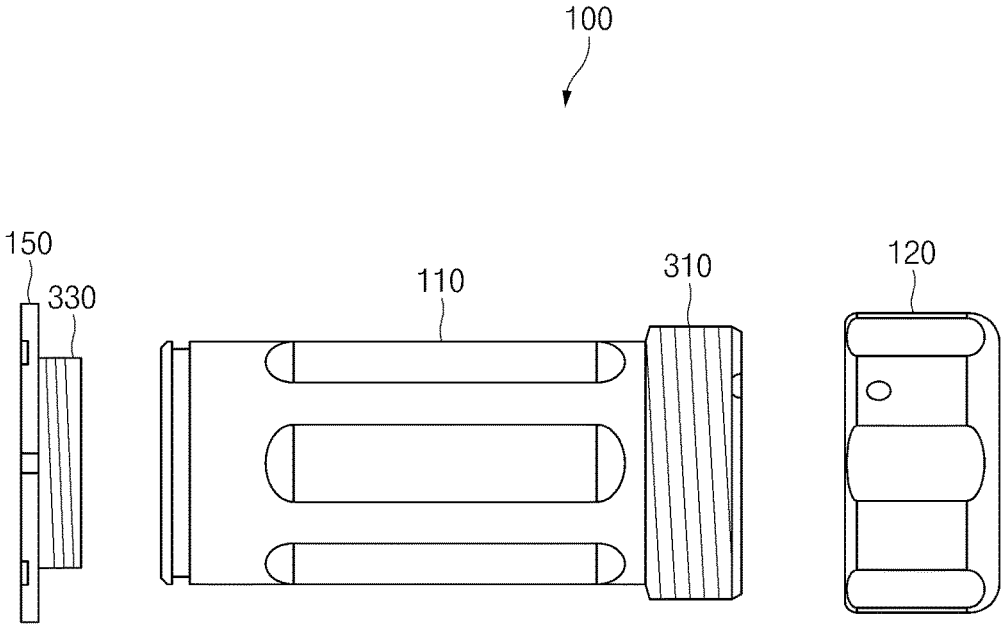
FIG. 25 is a view for explaining a method of coupling a body, a cap, and a connecting unit of a waterproof cable connector, according to an embodiment of the present disclosure.
Figure 26:
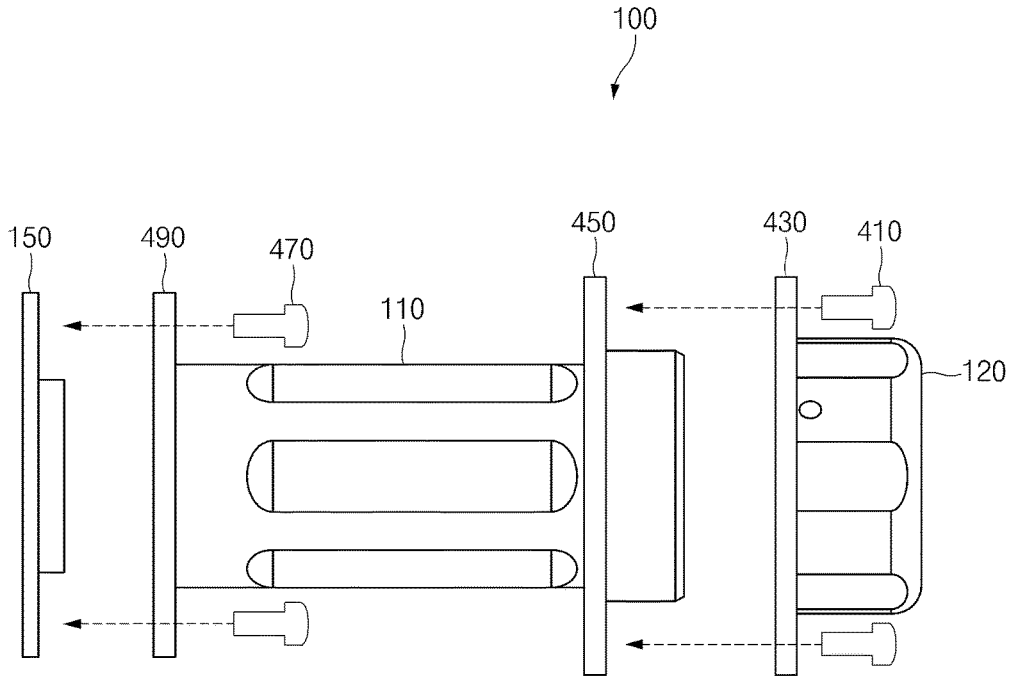
FIG. 26 is a view for explaining another method of coupling a body, a cap, and a connecting unit of a waterproof cable connector, according to an embodiment of the present disclosure.
Figure 27:
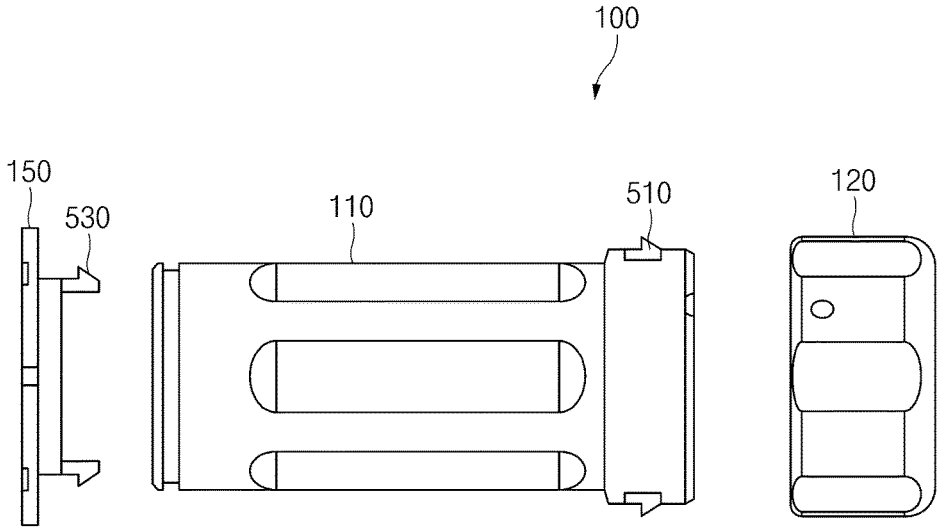
FIG. 27 is a view for explaining another method of coupling a body, a cap, and a connecting unit of a waterproof cable connector, according to an embodiment of the present disclosure.

FIG. 25 is a view for explaining a method of coupling a body, a cap, and a connecting unit of a waterproof cable connector, according to an embodiment. FIG. 26 is a view for explaining another method of coupling a body, a cap, and a connecting unit of a waterproof cable connector, according to an embodiment. FIG. 27 is a view for explaining another method of coupling a body, a cap, and a connecting unit of a waterproof cable connector, according to an embodiment.

Referring to FIGS. 25 to 27, the body 110, the cap 120, and the connecting unit 150 of the waterproof cable connector 100 may be coupled together through various methods. According to an embodiment, as illustrated in FIG. 25, the body 110 may have a screw structure 310 formed on the outer surface of the upper part 113 thereof, and the cap 120 may have a screw structure (not illustrated) formed on the inner surface thereof to correspond to the screw structure 310 such that the cap 120 may be screwed onto and secured to the body 110. Furthermore, the body 110 may have a screw structure (not illustrated) formed on the inner surface of the lower part 115 thereof, and the connecting unit 150 may have a screw structure formed on the outer surface of the central part 152 thereof to correspond to the screw structure of the body 110.

According to an embodiment, as illustrated in FIG. 26, the body 110 may have a first screw fixing plate 450 formed on the outer surface of the upper part 113 thereof, and the cap 120 may have a second screw fixing plate 430 formed on the outer surface thereof. In this case, the first screw fixing plate 450 and the second screw fixing plate 430 may be brought into close contact with each other and may be coupled together through a first screw member 410. Furthermore, the body 110 may have a third screw fixing plate 490 formed on the outer surface of the lower part 115 thereof, and the connecting unit 150 may have a fourth screw fixing plate (not illustrated) formed on the peripheral part 151 thereof. In this case, the third screw fixing plate 490 and the fourth screw fixing plate may be brought into close contact with each other and may be coupled together through a second screw member 470.

According to another embodiment, as illustrated in FIG. 27, the body 110 may have a hook 510 formed on the outer surface of the upper part 113 thereof, and the cap 120 may have a stopper (not illustrated) formed on the inner surface thereof to correspond to the hook 510. Furthermore, the body 110 may have a stopper (not illustrated) formed on the inner surface of the lower part 115 thereof, and the connecting unit 150 may have a hook 530 formed on the outer surface of the central part 152 thereof to correspond to the stopper of the body 110.

According to various embodiments, a method of coupling the body 110, the cap 120, and the connecting unit 150 of the waterproof cable connector 100 may be implemented by a combination of the above-described methods. For example, the body 110 and the cap 120 may be coupled together through a bayonet structure and a protrusion corresponding to the bayonet structure, and the body 110 and the connecting unit 150 may be screw-coupled or hook-coupled with each other.

Figure 28A:
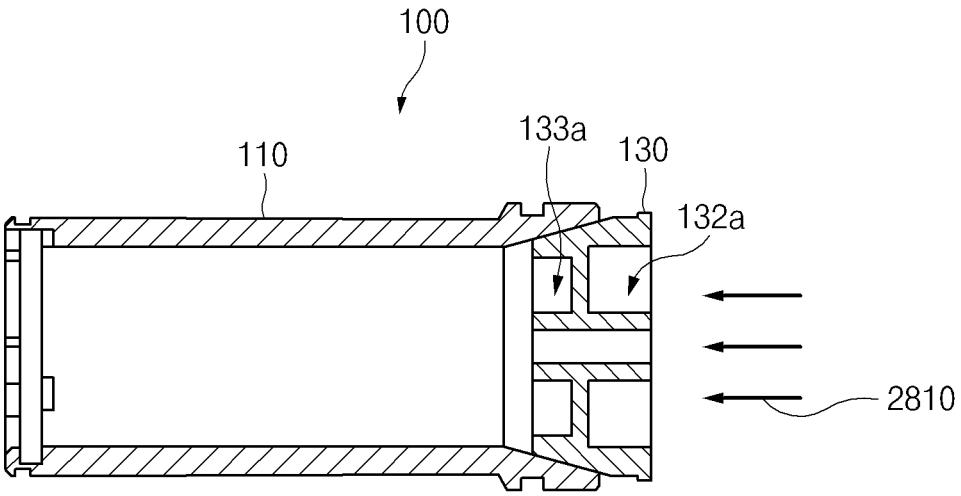
FIG. 28A and FIG. 28B are views for explaining compression of a sealing member of a waterproof cable connector, according to an embodiment of the present disclosure.
Figure 28B:
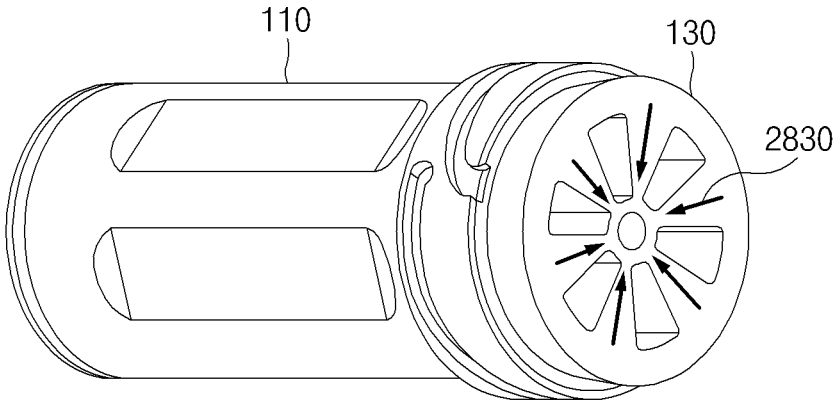

FIGS. 28A-28B is a view for explaining compression of a sealing member of a waterproof cable connector, according to an embodiment.

Referring to FIGS. 28A-28B, the sealing member 130 of the waterproof cable connector 100 may be inserted into the body 100 along the tapered surface 113*b*, which is formed on the inner surface of the body 110 of the waterproof cable connector 100, by external pressure applied thereto in a longitudinal direction 2810 of the waterproof cable connector 100 (e.g., a direction toward the inside of the body 110). At this time, the sealing member 130 may be compressed inside the body 110.

According to an embodiment, the sealing member 130 may have at least one recess (or cut-out region) formed in the upper surface or the lower surface thereof so that the sealing member 130 may be uniformly compressed when inserted into the body 110. For example, the sealing member 130 may include the first recess 132*a* formed to a specified depth in the direction from the upper surface to the lower surface thereof and the second recess 133*a* formed to a specified depth in the direction from the lower surface to the upper surface thereof.

The at least one recess (e.g., the first recess 132*a* and the second recess 133*a*) formed in the sealing member 130 may provide a space by which a lateral part of the sealing member 130 easily moves in the direction 2830 toward the center of the sealing member 130 when the sealing member 130 is compressed. Accordingly, the sealing member 130 may not be crushed when compressed.

Figure 29:
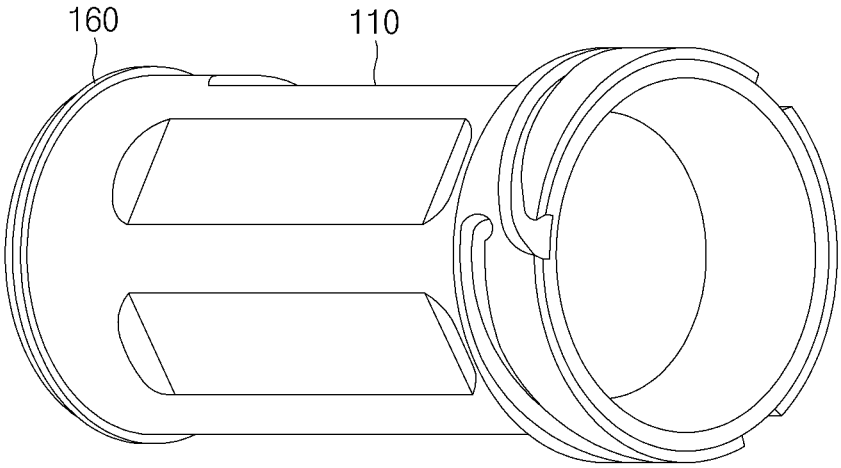
FIG. 29 is a view for explaining a waterproof member for waterproofing between a waterproof cable connector and an electronic device, according to an embodiment of the present disclosure.
Figure 30:
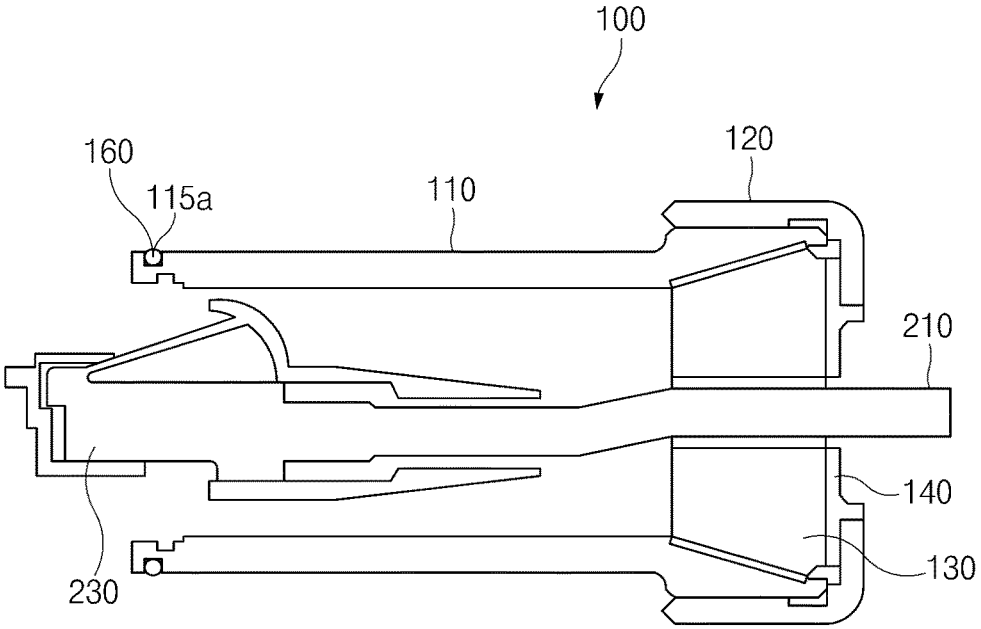
FIG. 30 is a sectional view of a waterproof cable connector having a waterproof member coupled thereto, according to an embodiment of the present disclosure.
Figure 31A:
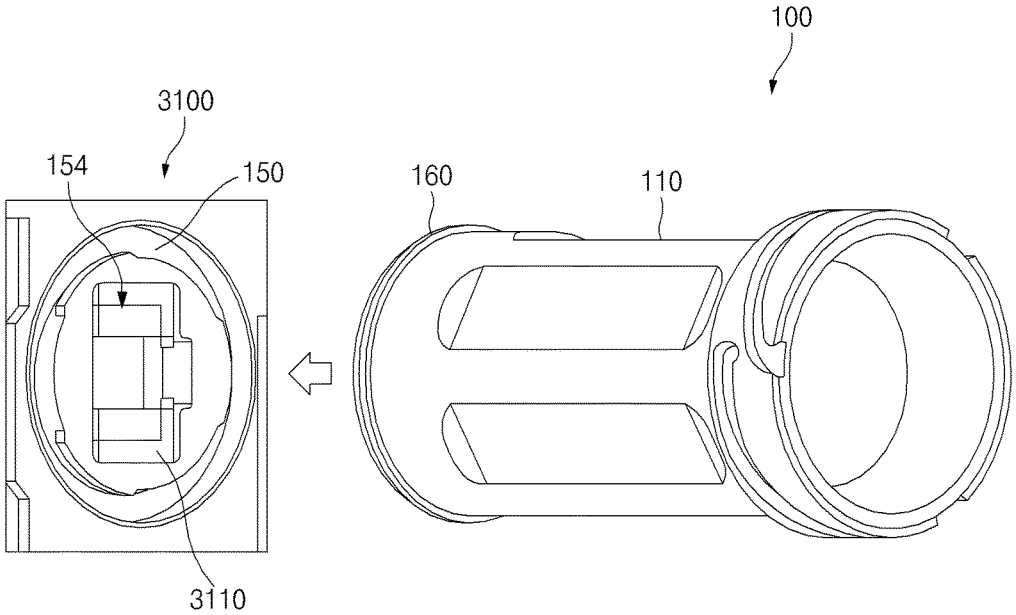
FIG. 31A and FIG. 31B are views for explaining coupling of an electronic device and a waterproof cable connector having a waterproof member coupled thereto, according to an embodiment of the present disclosure.
Figure 31B:
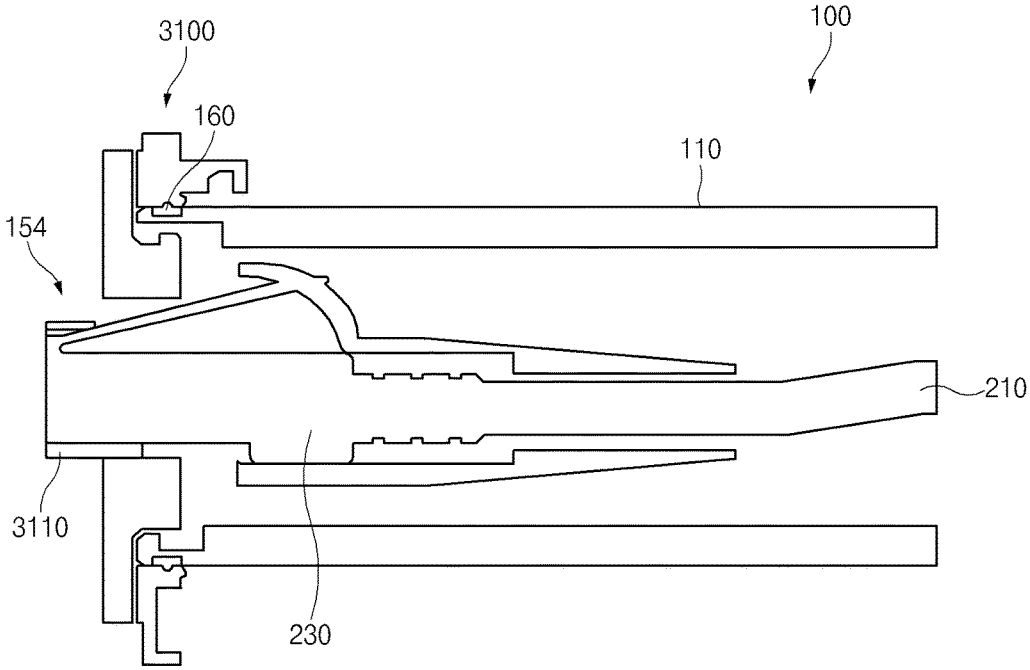
Figure 31C:
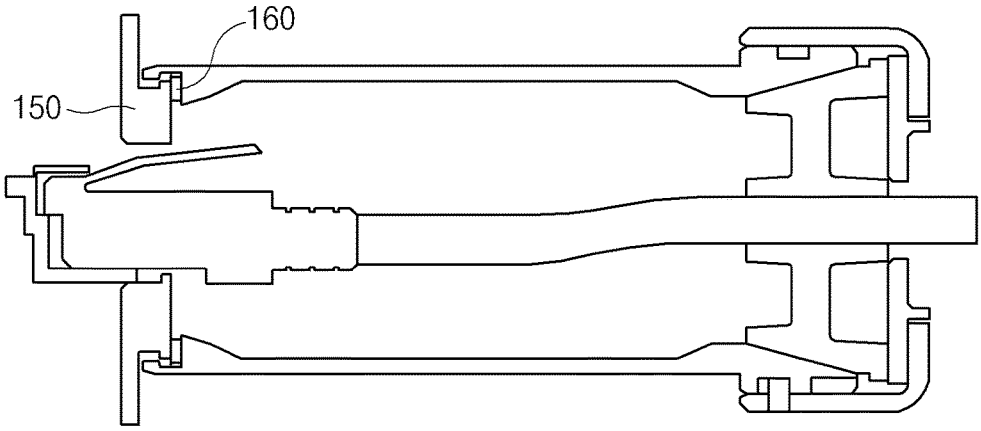
FIG. 31C is a view for explaining another arrangement of a waterproof member, according to an embodiment of the present disclosure.

FIG. 29 is a view for explaining a waterproof member for waterproofing between a waterproof cable connector and an electronic device, according to an embodiment. FIG. 30 is a sectional view of a waterproof cable connector having a waterproof member coupled thereto, according to an embodiment. FIGS. 31A-31B are views for explaining coupling of an electronic device and a waterproof cable connector having a waterproof member coupled thereto, according to an embodiment. FIG. 31C is a view for explaining another arrangement of a waterproof member, according to an embodiment.

Referring to FIGS. 29 to 31C, the waterproof cable connector 100 may further include the waterproof member 160 for waterproofing between the waterproof cable connector 100 and an electronic device 3100 to which the cable 210 is connected. For example, while the connecting unit 150 of the waterproof cable connector 100 is fastened to the electronic device 3100 as in a first state of FIG. 31A and the connecting part 230 on the distal end of the cable 210 is inserted into a cable connector 3110 of the electronic device 3100 as in a second state of FIG. 31B, the waterproof member 160 may be mounted to surround a portion of the outer surface of the body 110 to allow the body 110 of the waterproof cable connector 100 to be brought into close contact with the electronic device 3100.

According to an embodiment, as illustrated in FIG. 30, the area 115*a* of the body 110 where the lower part 115 and the middle part 111 are connected may be recessed, and the waterproof member 160 may be mounted in the recessed area 115*a* if the waterproof member 160 is mounted on the body 110. According to an embodiment, the waterproof member 160 may have a strap shape and may be formed of an elastic material (e.g., rubber) having a specified elasticity. For example, the waterproof member 160 may include an O-ring.

According to an embodiment, as illustrated in FIG. 31C, the waterproof member 160 may be disposed on the inner surface of the body 110 of the waterproof cable connector 100. In this case, if the body 110 is fastened to the connecting unit 150, the waterproof member 160 may be located between the inner surface of the lower part 115 of the body 110 and the central part 152 of the connecting unit 150 to allow the body 110 and the connecting unit 150 to make close contact with each other. Accordingly, in the state in which the connecting unit 150 is fastened to the electronic device 3100, the waterproof member 160 may allow the body 110 and the connecting unit 150 to make close contact with each other, thereby implementing waterproofing.

Figure 32A:
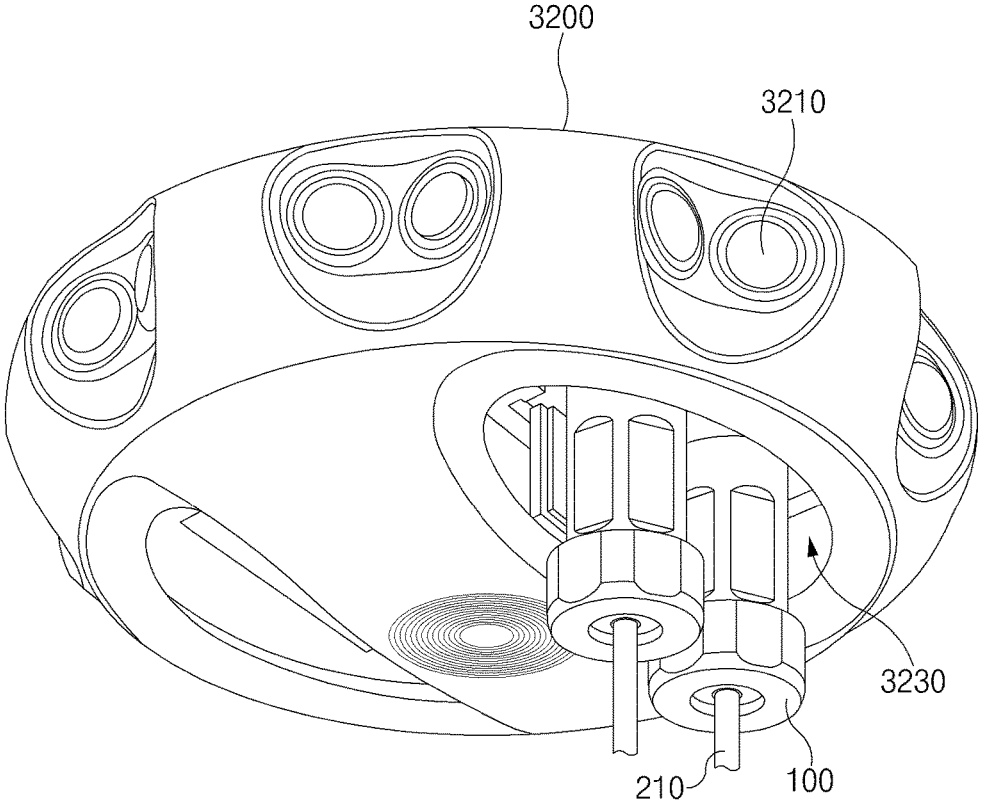
FIG. 32A is a perspective view of an electronic device to which a waterproof cable connector is fastened, according to an embodiment of the present disclosure.
Figure 32B:
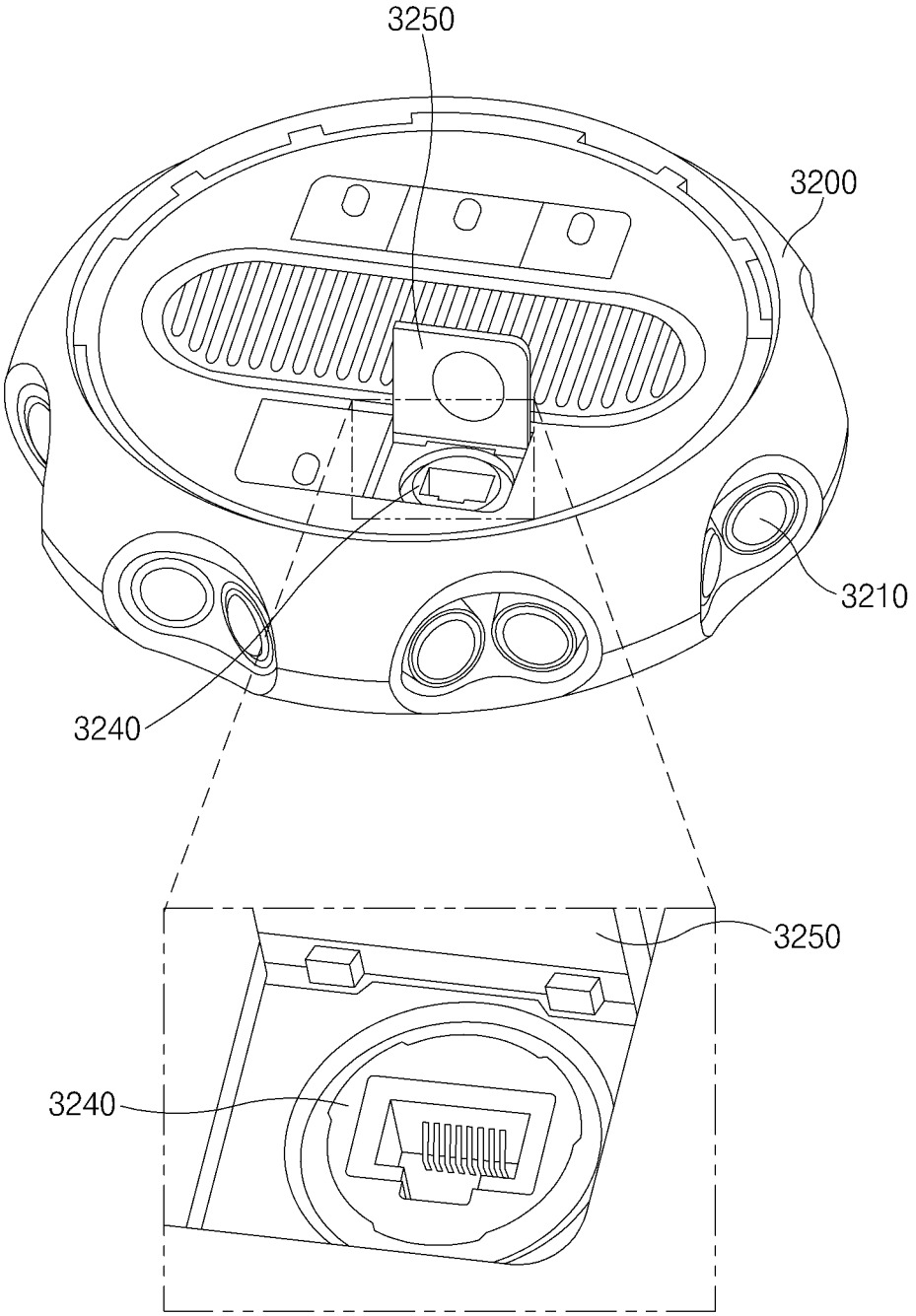
FIG. 32B is a view for explaining a cable connector of an electronic device, according to an embodiment of the present disclosure.

FIG. 32A is a perspective view of an electronic device to which a waterproof cable connector is fastened, according to an embodiment. FIG. 32B is a view for explaining a cable connector of an electronic device, according to an embodiment.

Referring to FIGS. 32A and 32B, an electronic device 3200 may be an electronic device used outdoors. Furthermore, the electronic device 3200 may be an electronic device for taking an omni-directional (e.g., 360-degree) image through a camera 3210. According to an embodiment, when the electronic device 3200 takes an image outdoors by using the camera 3210, a cable connector 3240 on the exterior of the electronic device 3200 may need waterproofing in case of rain. In an embodiment, the electronic device 3200 may have an opening 3230 formed in a housing thereof to accommodate the cable connector 3240, or may include a cover 3250 to cover the cable connector 3240. However, the cover 3250 may have to be open to connect the cable 210, and the cable connector 3240 may have a limitation in waterproofing performance even though the cable connector 3240 is disposed in the opening 3230. Accordingly, the electronic device 3200 used outdoors or in a wet area may use the waterproof cable connector 100 of the present disclosure to implement waterproofing.

According to an embodiment, the waterproof cable connector 100 may be fastened to the cable connector 3240 disposed on one surface of the electronic device 3200. According to an embodiment, the cable connector 3240 may include a LAN jack or a power jack, and a LAN (local area network) jack or a power plug on the distal end of the cable 210 may be fastened to the LAN jack or the power jack.

FIGS. 33 to 36 are views for explaining electronic devices to which a waterproof cable connector according to an embodiment is fastened.

Figure 33:
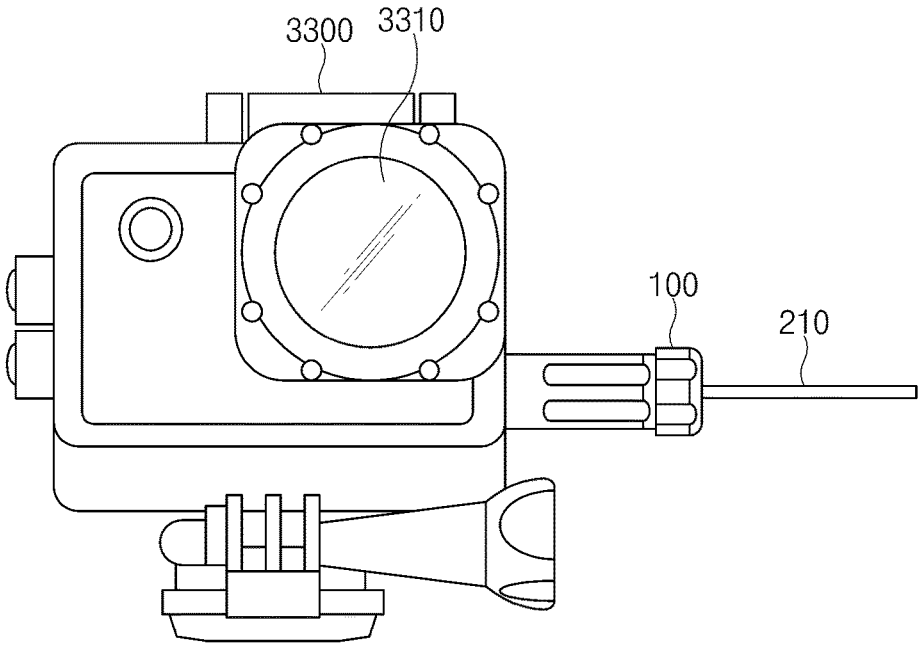
FIG. 33, FIG. 34, FIG. 35 and FIG. 36 are views for explaining electronic devices to which a waterproof cable connector according to an embodiment of the present disclosure is fastened.

Referring to FIGS. 33 to 36, an electronic device to which the waterproof cable connector 100 is fastened may include, for example, an electronic device used outdoors or an electronic device used in a wet area. According to an embodiment, as illustrated in FIG. 33, the electronic device may include an action camera device 3300 having a camera 3310. For example, the action camera device 3300 may use the waterproof cable connector 100 to connect the data cable 210.

Figure 34:
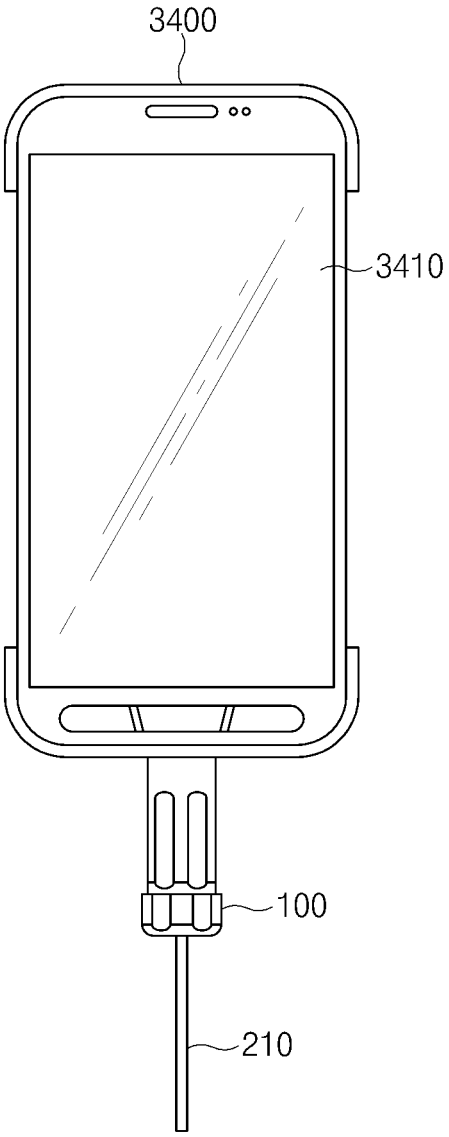

According to an embodiment, as illustrated in FIG. 34, the electronic device may include a mobile electronic device 3400, such as a smartphone. For example, the mobile electronic device 3400 may use the waterproof cable connector 100 to connect the power cable 210.

Figure 35:
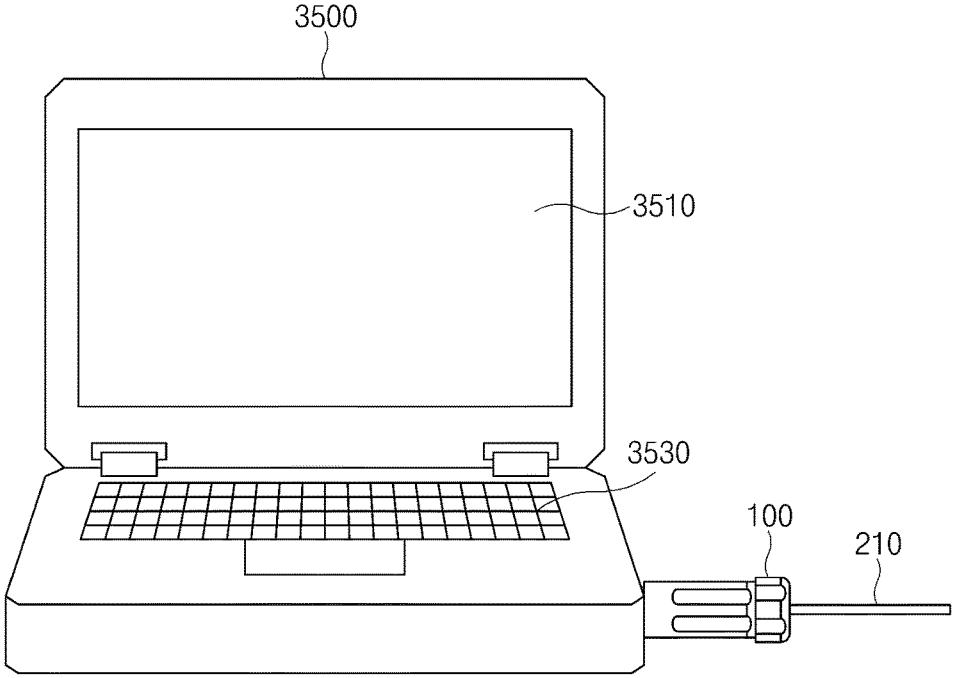

According to an embodiment, as illustrated in FIG. 35, the electronic device may include a laptop PC 3500 that is able to be used in an extreme environment. For example, the laptop PC 3500 may use the waterproof cable connector 100 to connect the cable 210.

Figure 36:
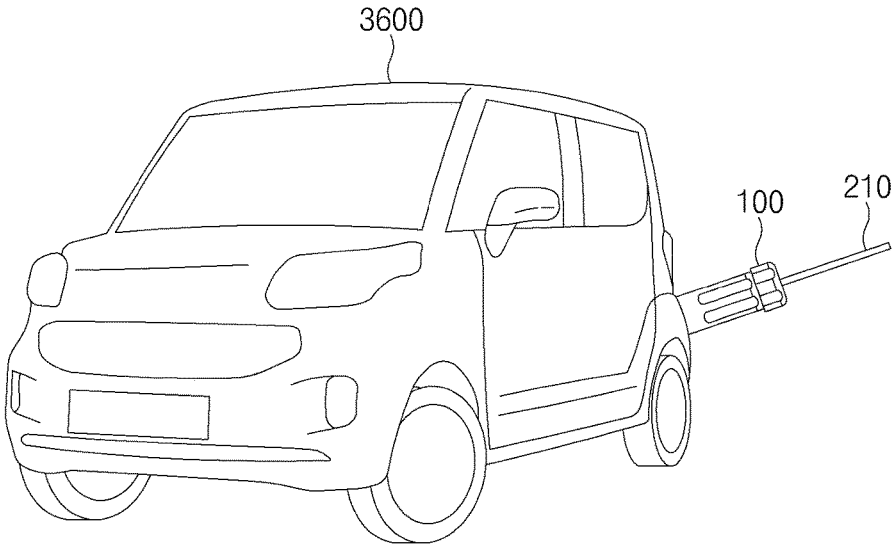

According to an embodiment, as illustrated in FIG. 36, the electronic device may include an electric vehicle 3600. For example, the electric vehicle 3600 may use the waterproof cable connector 100 to connect the fuel charging cable 210.

Figure 37:
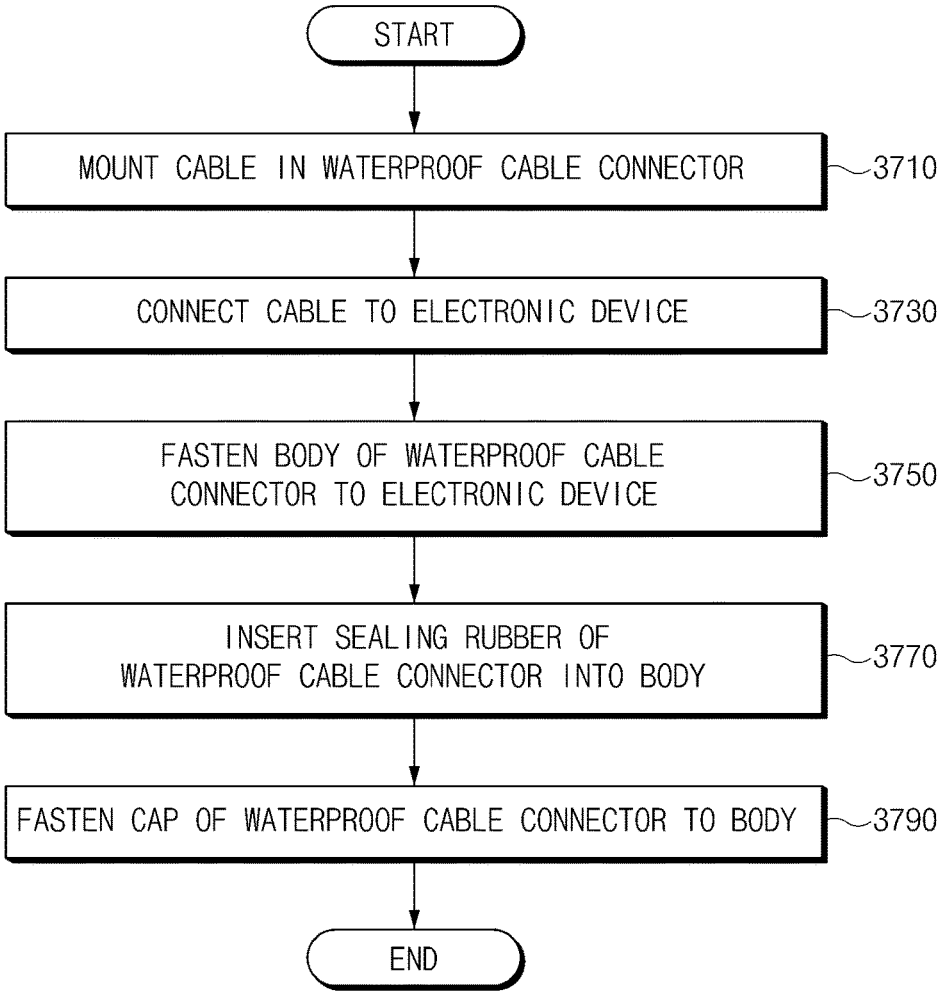
FIG. 37 is a flowchart illustrating a method for fastening a waterproof cable connector to an electronic device, according to an embodiment of the present disclosure.

FIG. 37 is a flowchart illustrating a method for fastening a waterproof cable connector to an electronic device, according to an embodiment.

Referring to FIG. 37, in a method for fastening the waterproof cable connector 100 to an electronic device, in operation 3710, the cable 210 may be mounted in the waterproof cable connector 100. For example, the cable 210 may be mounted in the waterproof cable connector 100 by inserting the cable 210 into the hollow interior 129 formed in the cap 120 of the waterproof cable connector 100, inserting the cable 210 into the hole 134 of the sealing member 130 through the cutting line 135 formed in the sealing member 130 of the waterproof cable connector 100, and inserting the cable 210 into the hollow interior 117 formed in the body 110 of the waterproof cable connector 100. In an embodiment, the washer 140 may be located between the sealing member 130 and the cap 120 by using the opening 144 formed in the washer 140 of the waterproof cable connector 100. In another example, the cable 210 may be additionally inserted into the hollow interior 154 formed in the connecting unit 150 of the waterproof cable connector 100.

In operation 3730, the cable 210 may be connected to the electronic device. For example, a connecting part (e.g., a plug) on the distal end of the cable 210 may be fastened to a cable connector (e.g., a jack) of the electronic device.

In operation 3750, the body 110 of the waterproof cable connector 100 may be fastened to the electronic device. According to an embodiment, the body 110 may be fastened to a connecting unit installed in the electronic device. For example, the body 110 may be fastened to the connecting unit through bayonet coupling, screw coupling, hook coupling, or the like. In an embodiment, in the case where the connecting unit 150 is included in the waterproof cable connector 100, for example, in the case where the cable 210 is inserted into the hollow interior 154 formed in the connecting unit 150, the connecting unit 150 of the waterproof cable connector 100 may be fastened to the electronic device. In this case, the connecting unit 150 may be screw-coupled with the electronic device by inserting a screw member into the screw hole 155 formed in the connecting unit 150.

In operation 3770, the sealing member 130 of the waterproof cable connector 100 may be inserted into the body 110. According to an embodiment, the sealing member 130 having a tapered surface on the outside thereof may be inserted into the body 110 having a tapered surface on the inside thereof.

In operation 3790, the cap 120 of the waterproof cable connector 100 may be fastened to body 110. According to an embodiment, the cap 120 may be fastened to the body 110 through bayonet coupling, screw coupling, hook coupling, or the like.

Figure 38A:
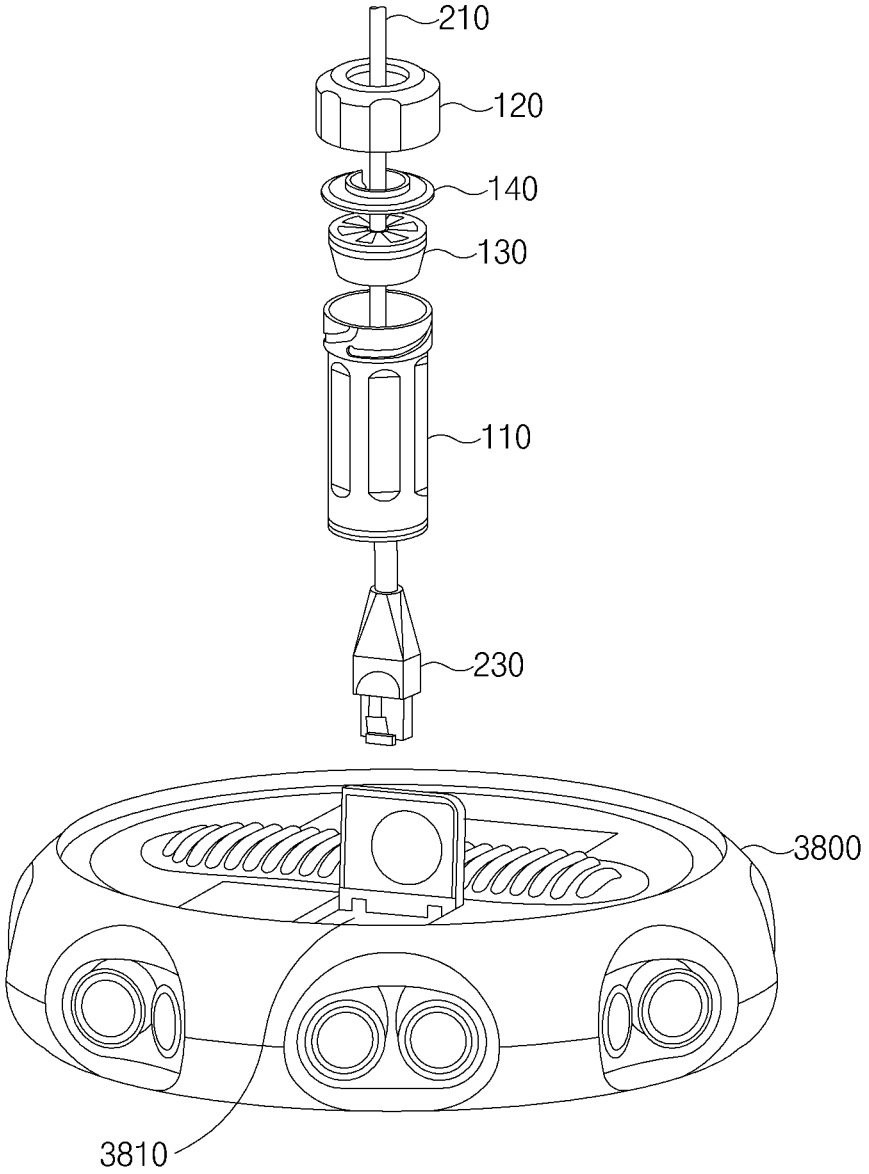
FIG. 38A and FIG. 38B illustrate an example of fastening a waterproof cable connector to an electronic device, according to an embodiment of the present disclosure.
Figure 38B:
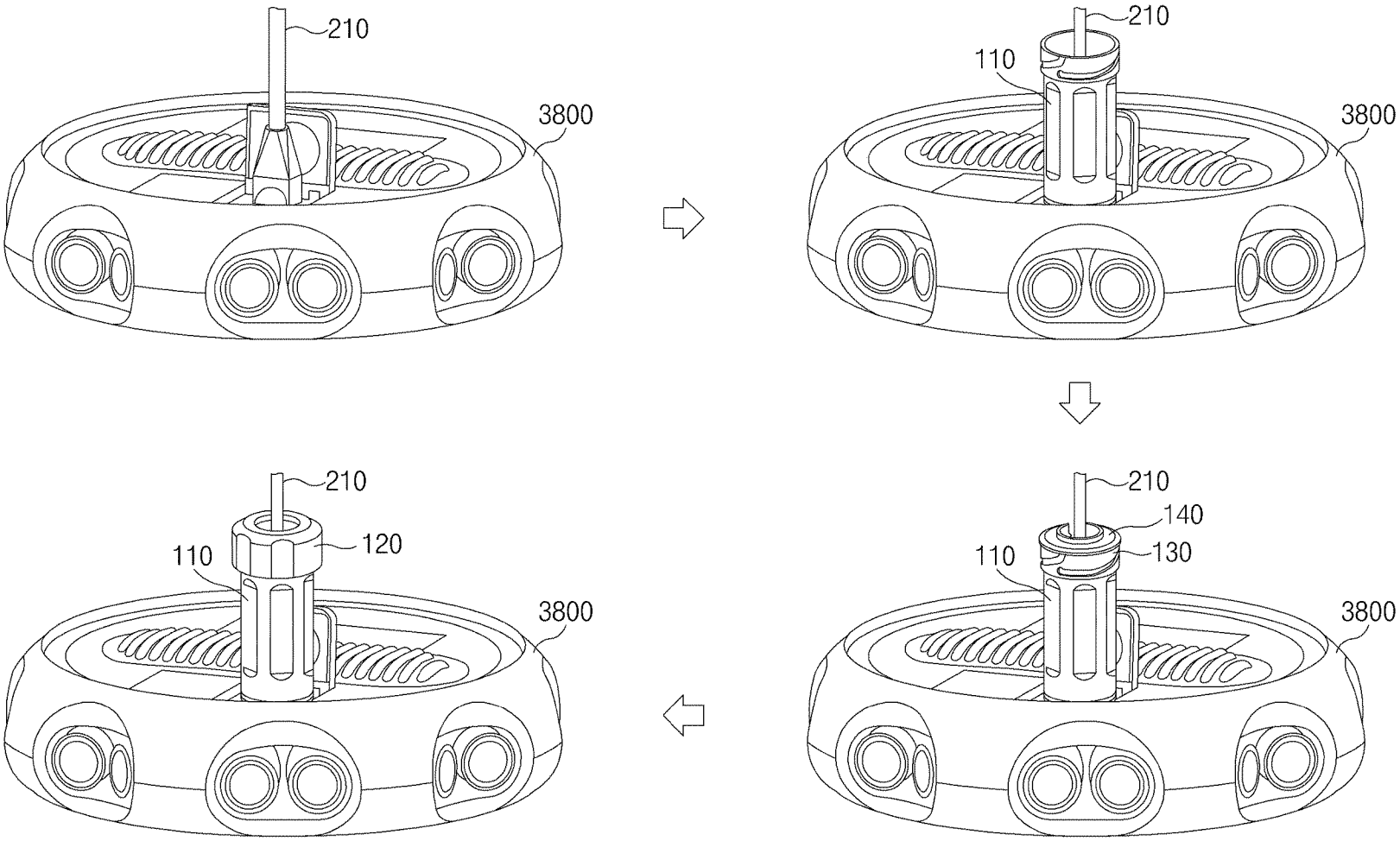

FIGS. 38A and 38B illustrate an example of fastening a waterproof cable connector to an electronic device, according to an embodiment.

As illustrated in FIG. 38A, the cable 210 may be mounted in the waterproof cable connector 100. For example, the cable 210 may be inserted into the cap 120 by inserting the connecting part 230 on the distal end of the cable 210 into the hollow interior 129 formed in the cap 120 of the waterproof cable connector 100. The cable 210 may be inserted into the body 110 by inserting the connecting part 230 on the distal end of the cable 210 into the hollow interior 117 formed in the body 110 of the waterproof cable connector 100. The cable 210 may be inserted into the hole 134, which is formed in the sealing member 130, through the cutting line 135 formed in the sealing member 130 of the waterproof cable connector 100. Additionally, the washer 140 may be located between the sealing member 130 and the cap 120 through the opening 144 formed in the washer 140 of the waterproof cable connector 100.

As illustrated in FIG. 38B, the connecting part 230 on the distal end of the cable 210 may be fastened to a cable connector of an electronic device 3800 after the cable 210 is mounted in the waterproof cable connector 100. The body 110 of the waterproof cable connector 100 may be coupled to the connecting unit 150 installed in the electronic device 3800. The sealing member 130 of the waterproof cable connector 100 may be inserted into the body 110, and the washer 140 of the waterproof cable connector 100 may be located on the sealing member 130. The cap 120 of the waterproof cable connector 100 may be coupled with the body 110 to cover the sealing member 130. In this case, the washer 140 may press the sealing member 130 while being pressed by the cap 120.

Figure 39:
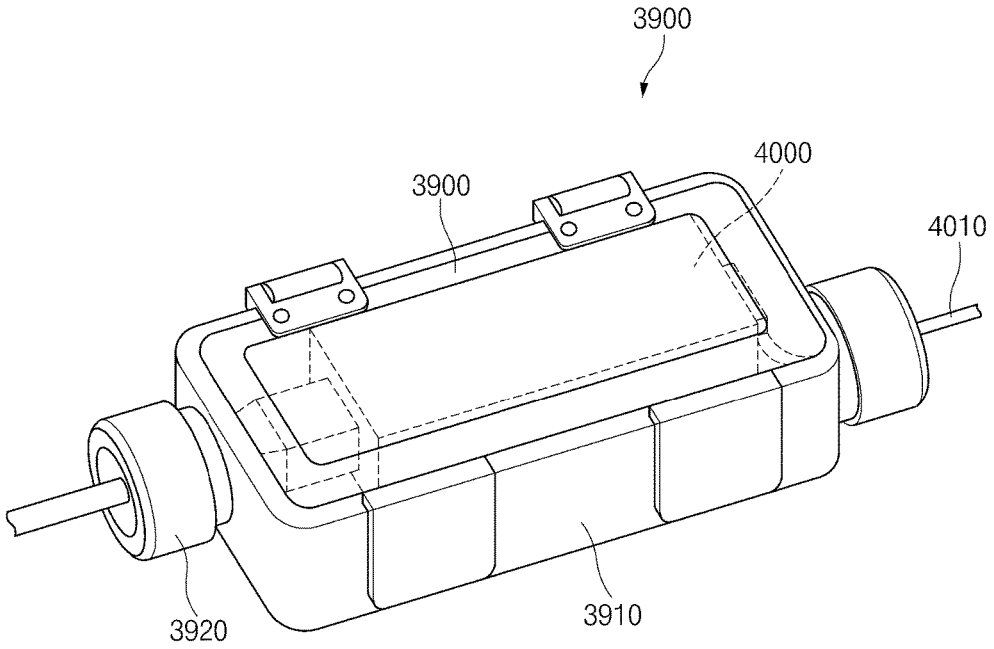
FIG. 39 is a perspective view of a waterproof cable connector for an adaptor, according to an embodiment of the present disclosure.
Figure 40:
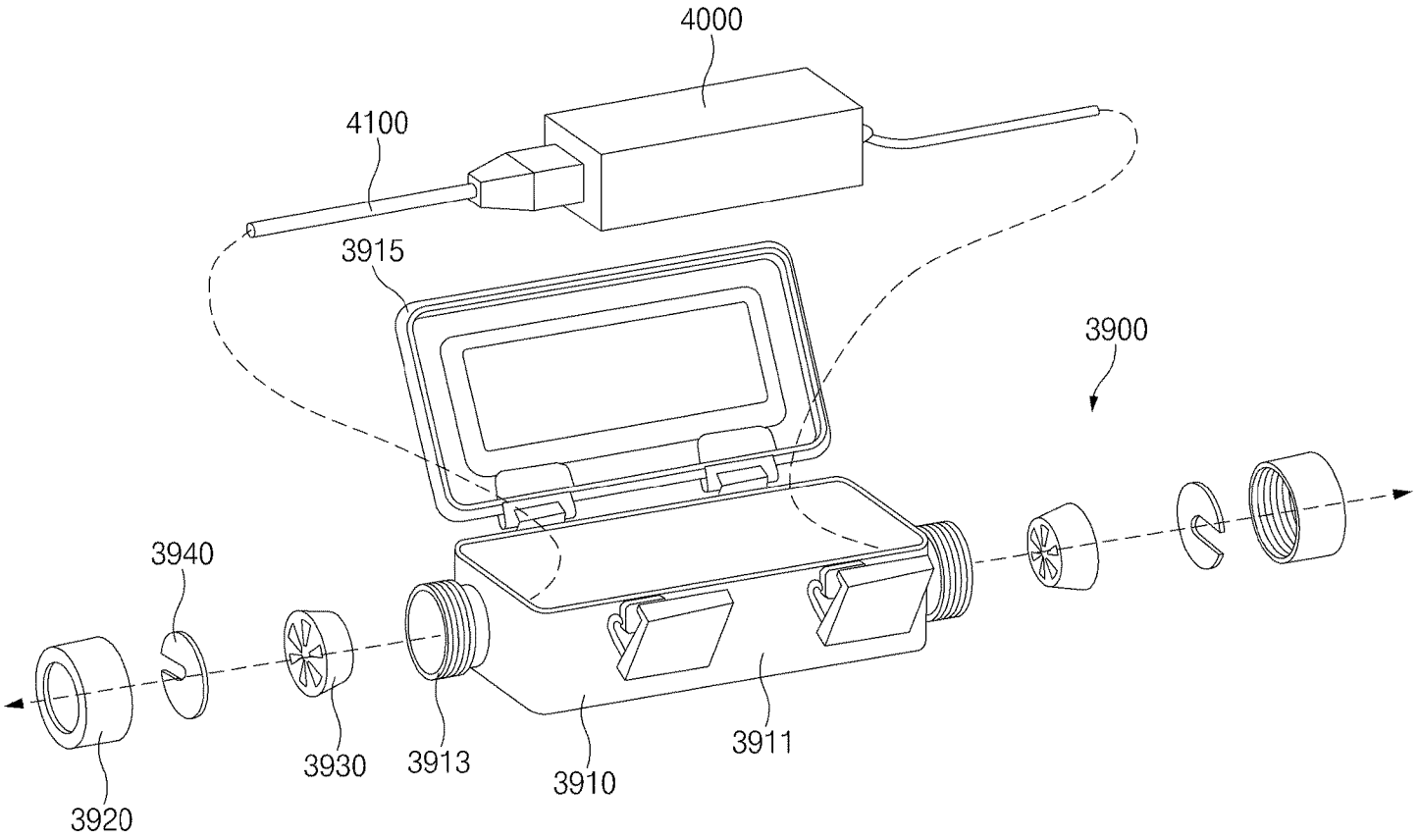
FIG. 40 is an exploded perspective view of the waterproof cable connector for the adaptor, according to an embodiment of the present disclosure.
Figure 41:
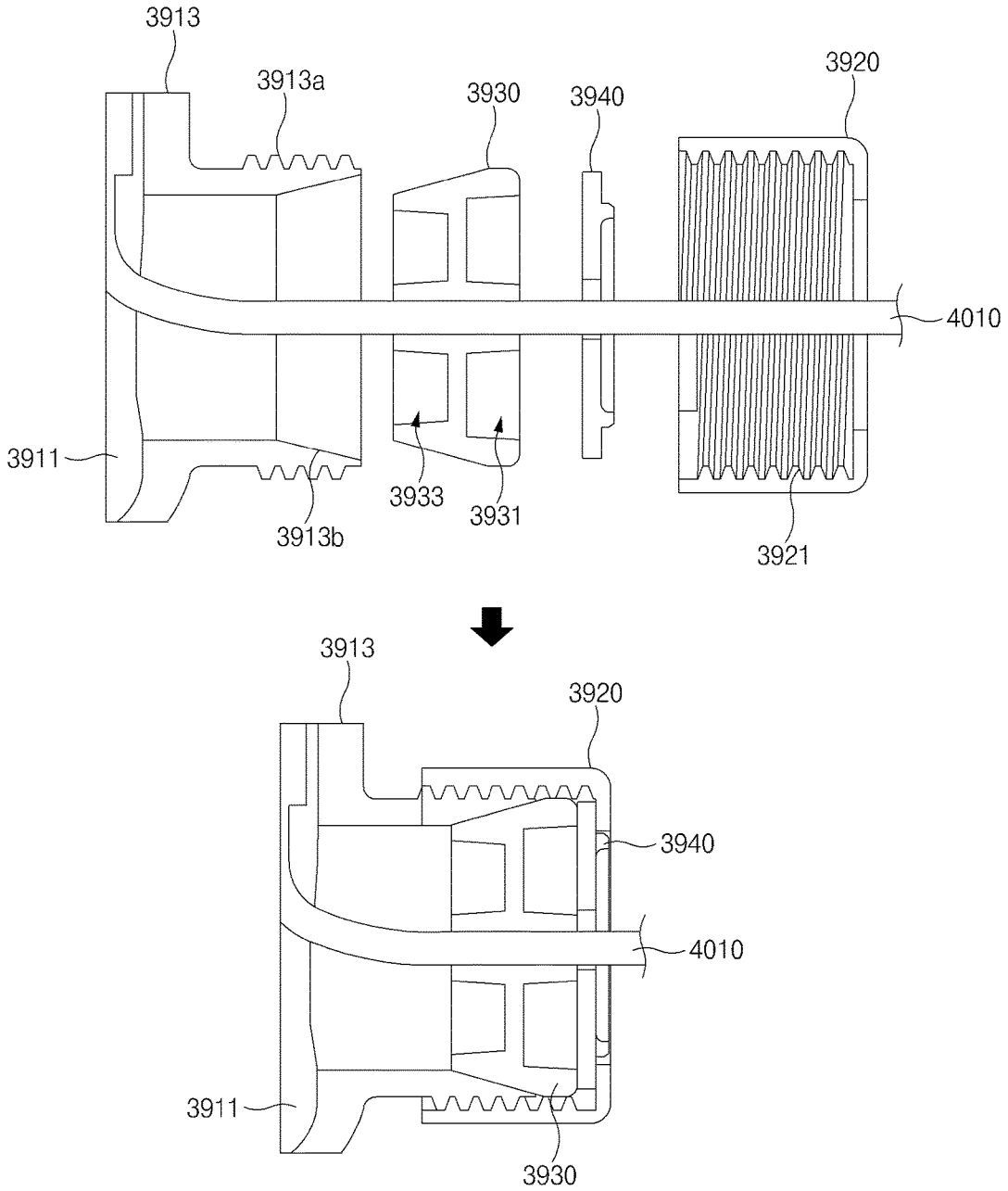
FIG. 41 is a sectional view of a part of the waterproof cable connector for the adaptor, according to an embodiment of the present disclosure.
Figure 42:
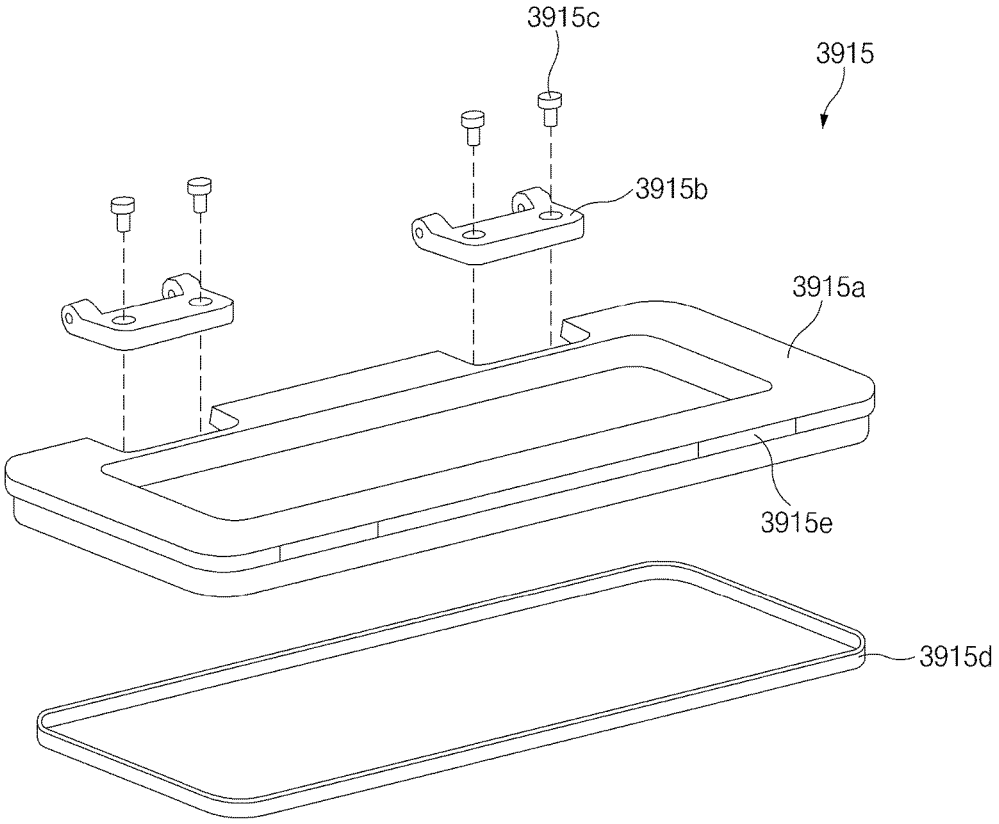
FIG. 42 is an exploded perspective view of a body cover of the waterproof cable connector for the adaptor, according to an embodiment of the present disclosure.
Figure 43:
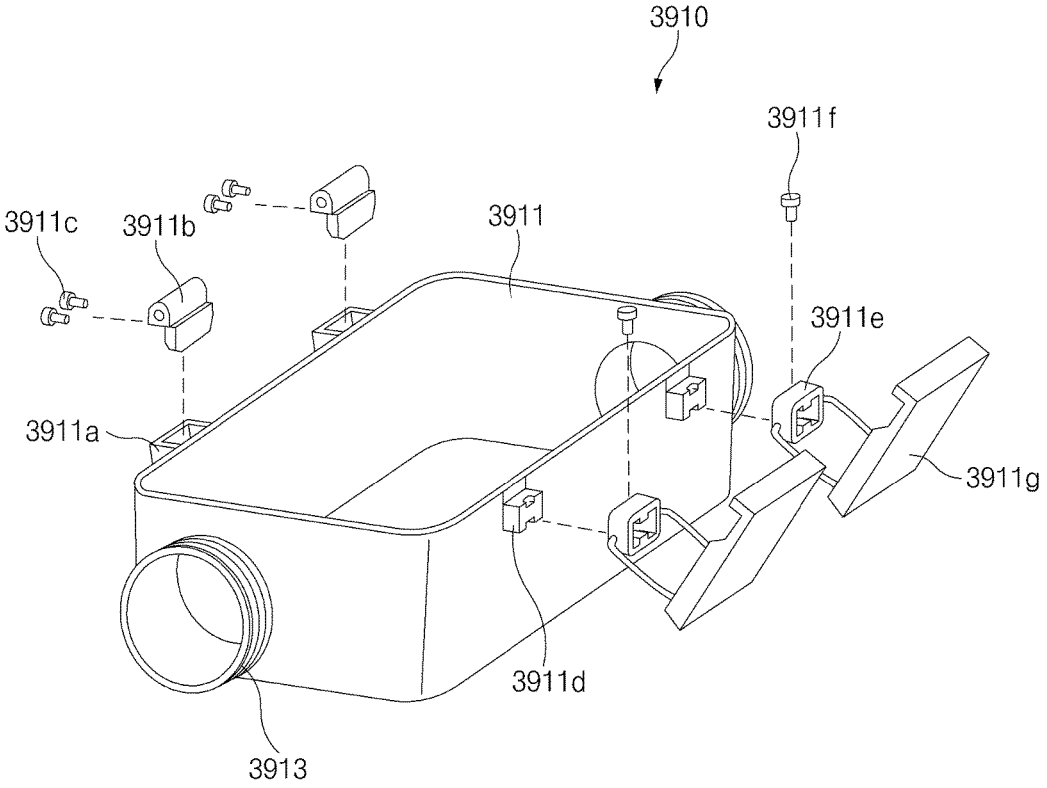
FIG. 43 is an exploded perspective view of a body of the waterproof cable connector for the adaptor, according to an embodiment of the present disclosure.
Figure 44:
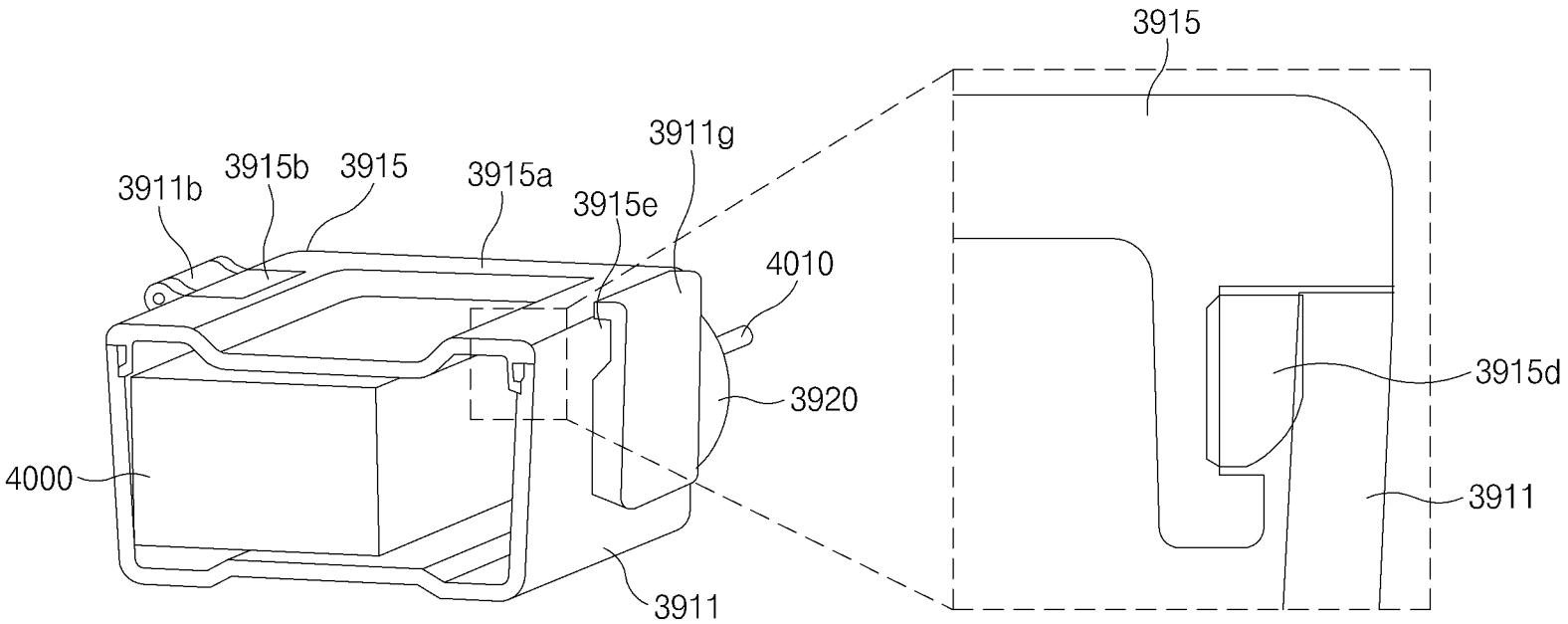
FIG. 44 is a sectional view of the waterproof cable connector for the adaptor, according to an embodiment of the present disclosure.

FIG. 39 is a perspective view of a waterproof cable connector for an adaptor, according to an embodiment. FIG. 40 is an exploded perspective view of the waterproof cable connector for the adaptor, according to an embodiment. FIG. 41 is a sectional view of a part of the waterproof cable connector for the adaptor, according to an embodiment. FIG. 42 is an exploded perspective view of a body cover of the waterproof cable connector for the adaptor, according to an embodiment. FIG. 43 is an exploded perspective view of a body of the waterproof cable connector for the adaptor, according to an embodiment. FIG. 44 is a sectional view of the waterproof cable connector for the adaptor, according to an embodiment.

Referring to FIGS. 39 to 44, a waterproof cable connector 3900 (e.g., the waterproof cable connector 100) may be provided for waterproofing of an adaptor 4000. The waterproof cable connector 3900 for the adaptor 4000 may include a body 3910, a cap 3920, and a sealing member 3930. However, a configuration of the waterproof cable connector 3900 is not limited thereto. According to various embodiments, the waterproof cable connector 3900 may further include at least one other element, in addition to the aforementioned elements. For example, the waterproof cable connector 3900 may further include a washer 3940.

The body 3910 may include a housing 3911 and cap fastening parts 3913 extending from opposite side surfaces of the housing 3911. The housing 3911 may include a front surface, a rear surface, and side surfaces surrounding a space between the front surface and the rear surface. The housing 3911 may have a shape in which the front surface is recessed toward the rear surface, to provide a space in which the adaptor 4000 is mounted.

The cap fastening parts 3913 may each have a substantially cylindrical shape. For example, a front surface and a rear surface (e.g., a surface extending from the housing 3911) of the cap fastening part 3913 may have a substantially circular shape, and a lateral surface of the cap fastening part 3913 may be formed to surround a space between the front surface and the rear surface of the cap fastening part 3913. The cap fastening part 3913 may have a hollow cylindrical shape through which a cable 4100 of the adaptor 4000 passes. For example, the cap fastening part 3913 may have a hollow interior extending through the rear surface and the front surface thereof.

According to an embodiment, the cap fastening part 3913 may have, on an outer surface thereof, a structure 3913*a* to which the cap 3920 is coupled. For example, a bayonet structure, a screw structure, a hook, a screw fixing plate, or the like may be formed on the outer surface of the cap fastening part 3913.

According to an embodiment, the cap fastening part 3913 may have a sloping portion on an inner surface thereof. For example, a portion of the inner surface of the cap fastening part 3913, into which the sealing member 3930 is inserted, may be a tapered surface 3913*b*.

The cap 3920 may be coupled with the cap fastening part 3913 to cover the front surface and a portion of the lateral surface of the cap fastening part 3913. For example, the cap 3920 may have an upper surface (or a front surface) and a lower surface (or a rear surface) that have a substantially circular shape, and a lateral surface of the cap 3920 may surround a space between the upper surface and the lower surface of the cap 3920. Furthermore, the lower surface of the cap 3920 may be recessed toward the upper surface of the cap 3920 to allow the cap 3920 to be coupled with the cap fastening part 3913. Furthermore, the cap 3920 may have an inner diameter larger than the outer diameter of the cap fastening part 3913. Furthermore, the cap 3920 may have a hollow interior extending through the upper surface and the lower surface thereof, into which the cable 4100 is inserted.

According to an embodiment, the cap 3920 may have, on an inner surface thereof, a structure 3921 that is to be coupled with the cap fastening part 3913. For example, the cap 3920 may have, on the inner surface thereof, a protrusion corresponding to the bayonet structure, a screw structure, a stopper corresponding to the hook, a screw fixing plate, or the like.

The sealing member 3930 may have a substantially cylindrical shape. For example, the sealing member 3930 may have an upper surface (or a front surface) and a lower surface (or a rear surface) that have a substantially circular shape, and a lateral surface of the sealing member 3930 may surround a space between the upper surface and the lower surface of the sealing member 3930. The sealing member 3930 may have a sloping portion on an outer surface thereof such that the sealing member 3930 is effectively inserted into the cap fastening part 3913. For example, a portion of the outer surface of the sealing member 3930, which is inserted into the cap fastening part 3913, may be tapered.

According to an embodiment, the sealing member 3930 may have at least one recess (e.g., a first recess 3931 and a second recess 3933) formed in the upper surface or the lower surface thereof. For example, the recess may be formed to a specified depth in the direction from the upper surface or the lower surface to the center of the sealing member 3930. According to an embodiment, the recess may have a fan shape. Furthermore, the sealing member 3930 may include a hole formed through the upper surface and the lower surface thereof, in which the cable 4100 is mounted.

According to an embodiment, the waterproof cable connector 3900 may include a cover 3915. The cover 3915 may be fastened to the housing 3910 to cover the front surface of the housing 3910. According to an embodiment, the cover 3915 may have the shape of a plate 3915*a*.

According to an embodiment, the cover 3915 may operate through a hinge on a side of the housing 3911. Furthermore, the cover 3915 may include a structure that is secured to the housing 3910. For example, the cover 3915 may include hinges 3915*b* fastened to a predetermined area of the plate 3915*a*, and the hinges 3915*b* may be secured to hinge shafts 3911*b*, which are connected to one side surface of the housing 3911, through first screw members 3915*c*.

According to an embodiment, the cover 3915 may include a structure that is secured to the housing 3911 in the state in which the cover 3915 covers the upper surface of the housing 3911. For example, the cover 3915 may have stoppers 3915*e* formed on a predetermined area of the plate 3915*a* (e.g., a side surface opposite to the surface on which the hinges 3915 are disposed). The stoppers 3915*e* may be configured such that hooks 3911*g* connected to one side surface of the housing 3911 (e.g., a side surface opposite to the surface on which the hinge shafts 3911*b* are disposed) are stopped by the stoppers 3915*e*.

According to an embodiment, the cover 3915 may have a waterproof member 3915*d* disposed on a surface that the cover 3915 faces when covering the upper surface of the housing 3911. The waterproof member 3915*d* may allow a lower lateral surface of the cover 3915 to make close contact with an upper lateral surface of the housing 3911. The waterproof member 3915*d* may be formed of, for example, rubber.

According to an embodiment, the housing 3911 may include a structure to which the hinge shafts 3911*b* are secured. For example, the housing 3911 may include hinge-shaft fixing parts 3911*a* on one side surface thereof, each of which provides a space into which the corresponding hinge shaft 3911*b* is inserted, and is coupled with the inserted hinge shaft 3911*b* through second screw members 3911*c*.

According to an embodiment, the housing 3911 may include a structure to which the hooks 3911*g* are secured. For example, the housing 3911 may include hook fixing parts 3911*d* on one side surface thereof, each of which provides a space into which the corresponding hook 3911*g* is inserted, and is coupled with the inserted hook 3911*g* through third screw members 3911*f*.

As described above, according to various embodiments, a waterproof cable connector (e.g., the waterproof cable connector 100) may include a body (e.g., the body 110) having a substantially cylindrical shape and including a first upper surface, a first lower surface, and a first lateral surface surrounding a space between the first upper surface and the first lower surface, the body having a first hollow interior extending through the first upper surface and the first lower surface, a sealing member (e.g., the sealing member 130) including a second upper surface, a second lower surface, and a second lateral surface surrounding a space between the second upper surface and the second lower surface and having a hole (e.g., the hole 134) formed through a portion of the second upper surface and a portion of the second lower surface, the sealing member being inserted into the body in a direction from the first upper surface to the first lower surface, and a cap (e.g., the cap 120) including a third upper surface, a third lower surface, and a third lateral surface surrounding a space between the third upper surface and the third lower surface and having a second hollow interior extending through a portion of the third upper surface and a portion of the third lower surface, the third lower surface being recessed toward the third upper surface and the cap being coupled with the body to cover the first upper surface and a portion of the first lateral surface. The body may have a tapered surface (e.g., the tapered surface 113*b*) formed on a portion of the inside of the first lateral surface that is adjacent to the first upper surface. The sealing member may have a tapered surface formed on a portion of the outside of the second lateral surface that is adjacent to the second lower surface. And at least one recess (e.g., the recess 132*a*, 133*a*) is formed in at least one of the second upper surface and the second lower surface.

According to various embodiments, the sealing member may have a cutting line (e.g., the cutting line 135) formed from the hole to the outside of the second lateral surface.

According to various embodiments, the body may be formed of a metal or plastic material having a specified stiffness or higher.

According to various embodiments, the sealing member may have a specified elasticity or higher.

According to various embodiments, the body may have a first screw structure formed on a portion of the outside of the first lateral surface that is adjacent to the first upper surface, and the cap may have a second screw structure formed on a portion of the inside of the third lateral surface, which is adjacent to the third lower surface, to correspond to the first screw structure formed on the body.

According to various embodiments, the body may have a bayonet structure (e.g., the bayonet structure 113*a*) formed on a portion of the outside of the first lateral surface that is adjacent to the first upper surface, and the cap may have a protrusion (e.g., the protrusion 123*a*) formed on a portion of the inside of the third lateral surface, which is adjacent to the third lower surface, to correspond to the bayonet structure formed on the body.

According to various embodiments, the body may have a hook formed on a portion of the outside of the first lateral surface that is adjacent to the first upper surface, and the cap may have a stopper formed on a portion of the inside of the third lateral surface, which is adjacent to the third lower surface, to correspond to the hook formed on the body.

According to various embodiments, the body may have a first screw fixing plate (e.g., the first screw fixing plate 450) formed on a portion of the outside of the first lateral surface that is adjacent to the first upper surface, the cap may have a second screw fixing plate (e.g., the second screw fixing plate 430) formed on a portion of the outside of the third lateral surface, which is adjacent to the third lower surface, to make close contact with the first screw fixing plate, and the first screw fixing plate and the second screw fixing plate are coupled together by a screw member (e.g., the first screw member 410).

According to various embodiments, the body may have a run-out groove (e.g., the run-out groove 111*a*) formed on the outside of the first lateral surface.

According to various embodiments, the cap may have a run-out groove (e.g., the run-out groove 121*a*) formed on the outside of the third lateral surface.

According to various embodiments, the waterproof cable connector may further include a washer (e.g., the washer 140) disposed between the sealing member and the cap to prevent the sealing member inserted into the body from escaping to the outside through the second hollow interior formed in the cap. The washer may have a through-hole (e.g., the through-hole 143) formed in a central portion of the washer and may have a larger diameter than the second hollow interior.

According to various embodiments, the washer may have an opening (e.g., the opening 144) formed from the through-hole to a portion of an outer surface of the washer.

According to various embodiments, the washer may have a protrusion (e.g., the protrusion 142) formed on one surface of the washer, and the protrusion may be exposed to the outside through the second hollow interior and is stopped by the third upper surface.

According to various embodiments, the protrusion may have a shape similar to the shape of the second hollow interior and may have a smaller diameter than the second hollow interior.

According to various embodiments, the waterproof cable connector may further include a connecting unit (e.g., the connecting unit 150). The connecting unit may have a third hollow interior (e.g., the hollow interior 154) formed in a portion of a central part of the connecting unit. And, one side of the connecting unit may be coupled with the body, and an opposite side of the connecting unit may be coupled to an electronic device to which a cable inserted in the waterproof cable connector is connected.

According to various embodiments, the central part of the connecting unit may have a protruding shape, and a first screw structure may be formed on a portion of the outside of the central part. And the body may have a second screw structure formed on a portion of the inside of the first lateral surface, which is adjacent to the first lower surface, to correspond to the first screw structure formed on the connecting unit.

According to various embodiments, the central part of the connecting unit may have a protruding shape, and a bayonet structure (e.g., the bayonet structure 115*b*) may be formed on a portion of the outside of the central part. And the body may have a protrusion (e.g., the protrusion 153) formed on a portion of the inside of the first lateral surface, which is adjacent to the first lower surface, to correspond to the bayonet structure formed on the connecting unit.

According to various embodiments, the central part of the connecting unit may have a protruding shape, and a hook may be formed on a portion of the outside of the central part. And the body may have a stopper formed on a portion of the inside of the first lateral surface, which is adjacent to the first lower surface, to correspond to the hook formed on the connecting unit.

According to various embodiments, the connecting unit may have a first screw fixing plate formed on a peripheral portion of the central part. The body may have a second screw fixing plate (e.g., the third screw fixing plate 490) formed on a portion of the outside of the first lateral surface, which is adjacent to the first lower surface, to make close contact with the first screw fixing plate. And the first screw fixing plate and the second screw fixing plate may be coupled together by a screw member (e.g., the second screw member 470).

According to various embodiments, the waterproof cable connector may further include a waterproof member (e.g., the waterproof member 160). The body may have an inwardly recessed area on a portion of the outside of the first lateral surface that is adjacent to the first lower surface. And the waterproof member may have a strap shape and may be formed of a material having a specified elasticity and may be mounted in the recessed area.

The term "module" used herein may represent, for example, a unit including one of hardware, software and firmware or a combination thereof. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific integrated circuit (ASIC) chip, a field-programmable gate array (FPGA), and a programmable-logic device for performing some operations, which are known or will be developed.

At least a part of devices (e.g., modules or functions thereof) or methods (e.g., operations) according to various embodiments of the present disclosure may be implemented as instructions stored in a computer-readable storage medium in the form of a program module. In the case where the instructions are performed by a processor, the processor may perform functions corresponding to the instructions.

A computer-readable recording medium may include a hard disk, a floppy disk, a magnetic medium (e.g., a magnetic tape), an optical medium (e.g., CD-ROM, digital versatile disc (DVD)), a magneto-optical medium (e.g., a floptical disk), or a hardware device (e.g., a ROM, a RAM, a flash memory, or the like). The program instructions may include machine language codes generated by compilers and high-level language codes that can be executed by computers using interpreters. The above-mentioned hardware device may be configured to be operated as one or more software modules for performing operations of various embodiments of the present disclosure and vice versa.

A module or a program module according to various embodiments of the present disclosure may include at least one of the above-mentioned elements, or some elements may be omitted or other additional elements may be added. Operations performed by the module, the program module or other elements according to various embodiments of the present disclosure may be performed in a sequential, parallel, iterative or heuristic way. Furthermore, some operations may be performed in another order or may be omitted, or other operations may be added.

While the present disclosure may have been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A waterproof cable connector, comprising:

a body having a substantially cylindrical shape and including a first upper surface, a first lower surface, and a first lateral surface surrounding a space between the first upper surface and the first lower surface, the body having a first hollow interior extending through the first upper surface and the first lower surface;

a sealing member including a second upper surface, a second lower surface, and a second lateral surface surrounding a space between the second upper surface and the second lower surface and having a hole formed through a portion of the second upper surface and a portion of the second lower surface, the sealing member being inserted into the body in a direction from the first upper surface to the first lower surface; and a cap including a third upper surface, a third lower surface, and a third lateral surface surrounding a space between the third upper surface and the third lower surface and having a second hollow interior extending through a portion of the third upper surface and a portion of the third lower surface, the third lower surface being recessed toward the third upper surface and the cap being coupled with the body to cover the first upper surface and a portion of the first lateral surface, wherein the body has a tapered surface formed on a portion of the inside of the first lateral surface that is adjacent to the first upper surface, wherein the sealing member has a tapered surface formed on a portion of an outside of the second lateral surface that is adjacent to the second lower surface, and wherein a plurality of recesses are formed in at least one of the second upper surface and the second lower surface of the sealing member, the plurality of recesses arranged circumferentially around the hole of the sealing member, and wherein each of the plurality of recesses includes a first opening formed in the second lateral surface of the sealing member, the first opening conjoined to a second opening formed in the second upper surface of the sealing member, as to form a continuous opening spanning from a portion of the second lateral surface to the second upper surface.

2. The waterproof cable connector of claim 1, wherein the sealing member has a cutting line formed from the hole to the outside of the second lateral surface.

3. The waterproof cable connector of claim 2, wherein the body is formed of a metal or plastic material having a stiffness greater than a predetermined value.

4. The waterproof cable connector of claim 1, wherein the sealing member has an elasticity greater than a predetermined value.

5. The waterproof cable connector of claim 1, wherein the body has a first screw structure formed on a portion of the outside of the first lateral surface that is adjacent to the first upper surface, and wherein the cap comprises a second screw structure formed on a portion of the inside of the third lateral surface, which is adjacent to the third lower surface, to correspond to the first screw structure formed on the body.

6. The waterproof cable connector of claim 1, wherein the body has a bayonet structure formed on a portion of the outside of the first lateral surface that is adjacent to the first upper surface, and wherein the cap has a protrusion formed on a portion of the inside of the third lateral surface, which is adjacent to the third lower surface, to correspond to the bayonet structure formed on the body.

7. The waterproof cable connector of claim 1, wherein the body has a hook formed on a portion of the outside of the first lateral surface that is adjacent to the first upper surface, and wherein the cap has a stopper formed on a portion of the inside of the third lateral surface, which is adjacent to the third lower surface, to correspond to the hook formed on the body.

8. The waterproof cable connector of claim 1, wherein the body has a first screw fixing plate formed on a portion of the outside of the first lateral surface that is adjacent to the first upper surface, wherein the cap has a second screw fixing plate formed on a portion of the outside of the third lateral surface, which is adjacent to the third lower surface, to make close contact with the first screw fixing plate, and wherein the first screw fixing plate and the second screw fixing plate are coupled together by a screw member.

9. The waterproof cable connector of claim 1, wherein the body has a run-out groove formed on the outside of the first lateral surface.

10. The waterproof cable connector of claim 1, wherein the cap has a run-out groove formed on the outside of the third lateral surface.

11. The waterproof cable connector of claim 1, further comprising:

a washer disposed between the sealing member and the cap to prevent the sealing member inserted into the body from escaping to the outside through the second hollow interior formed in the cap, wherein the washer has a through-hole formed in a central portion of the washer and has a smaller diameter than the second hollow interior of the cap.

12. The waterproof cable connector of claim 11, wherein the washer has an opening formed from the through-hole to a portion of an outer surface of the washer.

13. The waterproof cable connector of claim 11, wherein the washer has a protrusion formed on one surface of the washer, and wherein the protrusion is exposed to the outside through the second hollow interior and is stopped by the third upper surface.

14. The waterproof cable connector of claim 13, wherein the protrusion has a shape similar to the shape of the second hollow interior and has a smaller diameter than the second hollow interior.

15. The waterproof cable connector of claim 1, further comprising:

a connecting unit, wherein the connecting unit has a third hollow interior formed in a portion of a central part of the connecting unit, and wherein one side of the connecting unit is coupled with the body, and an opposite side of the connecting unit is coupled to an electronic device to which a cable inserted in the waterproof cable connector is connected.

16. The waterproof cable connector of claim 15, wherein the central part of the connecting unit has a protruding shape, and a first screw structure is formed on a portion of the outside of the central part, and wherein the body has a second screw structure formed on a portion of the inside of the first lateral surface, which is adjacent to the first lower surface, to correspond to the first screw structure formed on the connecting unit.

17. The waterproof cable connector of claim 15, wherein the central part of the connecting unit has a protruding shape, and a bayonet structure is formed on a portion of the outside of the central part, and wherein the body has a protrusion formed on a portion of the inside of the first lateral surface, which is adjacent to the first lower surface, to correspond to the bayonet structure formed on the connecting unit.

18. The waterproof cable connector of claim 15, wherein the central part of the connecting unit has a protruding shape, and a hook is formed on a portion of the outside of the central part, and wherein the body has a stopper formed on a portion of the inside of the first lateral surface, which is adjacent to the first lower surface, to correspond to the hook formed on the connecting unit.

19. The waterproof cable connector of claim 15, wherein the connecting unit has a first screw fixing plate formed on a peripheral portion of the central part, wherein the body has a second screw fixing plate formed on a portion of the outside of the first lateral surface, which is adjacent to the first lower surface, to make close contact with the first screw fixing plate, and wherein the first screw fixing plate and the second screw fixing plate are coupled together by a screw member.

20. The waterproof cable connector of claim 1, further comprising:

a waterproof member, wherein the body has an inwardly recessed area on a portion of the outside of the first lateral surface that is adjacent to the first lower surface, and wherein the waterproof member has a strap shape and is formed of a material having a specified elasticity and is mounted in the inwardly recessed area.

* * * * *